US009834991B2

(12) United States Patent
Simpson

(10) Patent No.: US 9,834,991 B2
(45) Date of Patent: Dec. 5, 2017

(54) DOWNHOLE TRACTION APPARATUS AND ASSEMBLY

(75) Inventor: Neil Andrew Abercrombie Simpson, Aberdeen (GB)

(73) Assignee: Paradigm Drilling Services Limited, Scotland (GB)

( * ) Notice: Subject to any disclaimer, the term of this patent is extended or adjusted under 35 U.S.C. 154(b) by 527 days.

(21) Appl. No.: 14/112,831

(22) PCT Filed: Apr. 19, 2012

(86) PCT No.: PCT/GB2012/050861
§ 371 (c)(1),
(2), (4) Date: Feb. 26, 2014

(87) PCT Pub. No.: WO2012/143722
PCT Pub. Date: Oct. 26, 2012

(65) Prior Publication Data

US 2014/0158432 A1 Jun. 12, 2014

(30) Foreign Application Priority Data

Apr. 19, 2011 (GB) ..... 1106595.0
Jul. 29, 2011 (GB) ..... 1113150.5

(51) Int. Cl.
*E21B 7/04* (2006.01)
*E21B 17/10* (2006.01)
*E21B 23/00* (2006.01)

(52) U.S. Cl.
CPC ..... *E21B 7/04* (2013.01); *E21B 17/1057* (2013.01); *E21B 2023/008* (2013.01)

(58) Field of Classification Search
CPC ..... E21B 17/1057; E21B 2023/008
See application file for complete search history.

(56) References Cited

U.S. PATENT DOCUMENTS 1,913,365 A * 6/1933 Bailey ..... E21B 17/1057 175/325.3
2,168,017 A 8/1939 Hammer
5,649,603 A 7/1997 Simpson
6,761,233 B1 7/2004 Aadland

FOREIGN PATENT DOCUMENTS

GB 2460129 A 11/2009
WO 9626351 A1 8/1996
WO 9806927 A1 2/1998
WO 0242601 A1 5/2002
WO 2012069795 A1 5/2012

* cited by examiner

*Primary Examiner* — Catherine Loikith
(74) *Attorney, Agent, or Firm* — William H. Honaker; Dickinson Wright PLLC

(57) ABSTRACT

An apparatus (10) includes a traction member in the form of a roller (24) configured for mounting on a body (12) so as to permit rotation of the roller (24) relative to the body (12). The roller (24) is mountable on the body (12) so as to define a skew angle relative to a longitudinal axis (26) of the body (12). In use, the roller (24) engages a wall of a borehole or bore-lining tubular and the roller (24) urges the apparatus (10) along the wall of the borehole or bore-lining tubular on rotation of the as the roller (24) rotates on the body (12).

17 Claims, 25 Drawing Sheets

DOWNHOLE TRACTION APPARATUS AND ASSEMBLY

CROSS-REFERENCE TO RELATED APPLICATION

This U.S. National Stage Patent Application claims the benefit of International Application serial number PCT/GB2012/050861 filed Apr. 19, 2012, which claims priority to GB patent application number 1106595.0 filed on Apr. 19, 2011 and GB patent application number 1113150.5 filed on Jul. 29, 2011, the entire disclosures of the applications being considered part of the disclosure of this application.

FIELD OF THE INVENTION

This invention relates to the provision of downhole traction and more particularly, but not exclusively to a downhole tool, assembly and method for providing downhole traction, torque reduction, thrust and/or wear protection in the drilling and/or completion of a high angle or horizontal wellbore.

BACKGROUND TO THE INVENTION

Within the oil and gas industry, the continuing search for and exploitation of oil and gas reservoirs has resulted in the development of directionally drilled exploration and production well boreholes, that is boreholes which extend away from vertical and which permit the borehole to extend into the reservoir to a greater extent. By extending the step-out distance from a fixed location such as an offshore platform, the high angle or horizontal section of the borehole passes through the producing formation, thereby maximising the surface area of the borehole in contact with the producing formation while also assisting in minimising water ingress. In this way, the production rate or quantity of the oil or gas being produced may be enhanced since the borehole is able to reach oil or gas which would otherwise be bypassed by a vertical or near vertical borehole.

Directionally drilled boreholes are now being drilled deeper, longer and higher in angle (from vertical) than previously, with boreholes now being drilled horizontally for considerable distances. Indeed, in some cases the horizontal step out from the position of the surface location of the drilling site may be as much as 11 kilometers.

The drilling and/or completion of a high angle or horizontal borehole presents a number of problems not present in vertical or near vertical wells.

For example, completion of a high angle or horizontal pre-drilled bore may incur problems resulting from the fact that the tubulars forming the running or completion string tend to lie on the low side of the bore, resulting in torque, drag and wear to the string and/or the surrounding bore-lining tubulars, typically casing or liner. In some cases, the extensive running and rotating of the tubulars through the horizontal cased section of the borehole can cause such severe wear to the wall of the casing that the casing pressure integrity is compromised. This may require that the completion be withdrawn (where indeed this is possible) or other remedial work or workover carried out, resulting in significant expense and delay to the operator.

Similarly, in the case of the drilling horizontal and high angle boreholes, the drill string itself will typically lie on the low side of the borehole wall, resulting in increased wear to the drill string, associated components and/or damage to the borehole.

The drilling of high angle and horizontal boreholes, while effective, may also suffer from a number of further performance reducing factors. For example, in order to create any borehole, it is necessary to exert sufficient force on the drill bit to enable the drill bit to drive through rock, known as weight on bit. In today's horizontal and high angle borehole drilling, the current method using rotary drilling equipment is for the weight on bit to be provided by the downward gravitational force of the portion of the drill string situated in the upper, vertical or lower angle (nearer to vertical) section of the borehole. This downward gravitational force, which is generally provided by heavy weight drilling tubulars, such as heavy weight drill pipe, is transmitted in the form of compression through the rotating drilling tubulars to the portion of the drill string situated in the lower, high angle or horizontal section of the borehole in order to apply the necessary weight on bit. However, it will be recognized that for boreholes having a significant non-vertical section, a major percentage of the drilling tubulars forming the lower portion of the drill string, which would normally contribute to the weight on bit in a vertical borehole, are unable to contribute to the weight on bit.

Also, compression applied to a long string of rotating drilling tubulars in a borehole tends to cause a degree of buckling and pipe whirl, forcing the rotating tubulars against the bore wall and again creating increased longitudinal friction, rotational friction and wear to the drilling tubulars.

Similar issues may also occur in running completion tools and assemblies into pre-existing boreholes.

Some of these factors can be mitigated by the provision of spacers known as stabilisers situated at strategic positions and in sufficient numbers along the drill string. However, the stabilisers themselves introduce a number of negative factors when applied in high angle and horizontal drilling or completion.

Drilling stabilisers typically fall into two main categories: fixed blade stabilisers and non-rotating stabilisers. Fixed blade stabilisers have a body for coupling to the drill string and, as their name implies, one or more blades either fixed to the body or formed as an integral part of the body. The blades, which are typically formed in a spiral to increase borehole wall contact, rotate with the drill string or completion string to which they are attached. By centralising the tubulars in the borehole and reducing wellbore wall contact, fixed blade stabilisers may address or mitigate the buckling or whirling effects of applied compressive loads. However, because the stabiliser blades by design remain in contact with the borehole wall and because friction is independent of area, fixed blade stabilisers do little to reduce the effect of rotational friction in the high angle or horizontal sections of the borehole where most of the weight of the drilling tubulars are now being supported by the stabiliser blades on the low side of the borehole.

It may be argued that by reducing the contact between the drill string and the borehole wall, stabilisers assist in keeping the drill string or completion string moving and, by virtue of the fact that dynamic friction of the stabiliser blade rotating against the borehole wall is lower than static friction, thus reduce longitudinal friction. However, the dynamic friction component remains and must also be overcome by the compressive forces applied through the tubulars, for example drilling tubulars, from higher up the borehole. This residual longitudinal dynamic friction component has to be considered as an unavoidable but detrimental factor associated with the use of fixed blade stabilisation in high angle and horizontal boreholes.

As in the case of fixed blade stabilisers, non-rotating stabilisers have a body for coupling to the drill string or completion string. However, in non-rotating stabilisers the stabiliser blades are attached to or are integral with a sleeve provided around the body. A bearing is provided between the outside of the body and the inside of the sleeve so that, in use, the sleeve and body are relatively rotatable (the sleeve is non-rotating relative to the rotating body and drill string). The main benefit of this type of stabiliser, besides centralising the rotating drilling tubulars, is to substantially reduce the rotational friction effect experienced by conventional fixed blade stabilisers. This is achieved by the bearing between the rotating tool body and the non-rotating sleeve being very much more efficient than the fixed blade stabiliser blades rotating against the inside diameter of the bore. However, the fact that the non-rotating stabiliser sleeve is effectively static with respect to the wall of the bore and given that static friction is higher than dynamic friction, this introduces a secondary negative factor that has a detrimental effect known as stick slip.

Stick slip is caused by the forces required to overcome the longitudinal static friction component of the non-rotating stabiliser blades in contact with the borehole wall when moving the drilling tubulars forward or down to apply more weight to the drill bit. These forces put the drilling tubulars, between the drill bit and the drilling tubulars higher up the bore that provide the applied force, into further compression like a compression spring so that when the lower section of drilling tubulars start to move to overcome the longitudinal static friction component, and because static friction is higher than dynamic friction, they do so in a "stick slip" fashion. For example, the drilling tubulars that form the lower part of the drill string and drilling assembly which are being supported and centralised by these non-rotating stabilisers stick initially, as the drilling tubulars are lowered or moved forward in order to apply further weight to the drill bit, and then slip driven by the compressed tubulars above them, once the static friction component is overcome, applying weight on bit in an uncontrollable manner.

Both rotational and longitudinal friction are major detrimental factors which reduce rotational input power and the ability to control applied weight on bit in high angle and horizontal rotary drilling applications, reducing the rate at which the borehole can be progressed and substantially increasing the cost to complete the bore, as well as the possibility of causing damage, and reduced life, to the drill bit.

In addition to the issues described above when drilling the borehole, if it is ever desired to move the drill string or running string or completion string in a reverse direction, that is out of hole, similar issues with friction may arise. Pulling the string out of a borehole having a high angle or horizontal section may suffer from a further problem in that the vertical pull force exerted on the string causes the curved portion of the string situated around the heel of the borehole to contact the upper wall of the borehole, known as the capstan effect. This may make it difficult or even impossible to pull the string out of the borehole.

SUMMARY OF THE INVENTION

According to a first aspect of the present invention there is provided an apparatus for location in a borehole, the apparatus comprising:

a traction member rotatably mountable on a body, wherein the traction member is mountable on the body so as to define a skew angle relative to a longitudinal axis of the body and is configured to engage a wall of a borehole or bore-lining tubular to urge the apparatus along the wall of the borehole or bore-lining tubular on rotation of the traction member relative to the body.

The provision of a skew angle introduces a longitudinal force component to the interaction between the traction member and wall of the borehole or bore-lining tubular which acts to urge the apparatus along the borehole or bore-lining tubular. Accordingly, the traction member may roll in a helical path rather than a circumferential path around the inside of the borehole or bore-lining tubular wall. This rolling helical path may have the effect of transporting the apparatus and any connected tubulars or components, such as a drill string, running string or completion string, along the wall of the borehole or bore-lining tubular.

Embodiments of the present invention beneficially provide downhole traction or thrust to urge the apparatus and any connected components along the borehole or bore-lining tubular and may eliminate or reduce the need to transmit longitudinal force from surface, for example in high angle or horizontal boreholes where it may not otherwise be possible to accurately control movement from surface. Embodiments of the present invention may provide controlled movement without the risk of the string becoming stuck due to the capstan effect. Embodiments of the invention may reduce the requirement for compressive forces to be transmitted from surface, thereby eliminating or reducing the detrimental effects of "stick slip" and permitting effective controllable weight on bit.

The traction member may be mountable on the body so that the traction member is offset from a central longitudinal axis of the body. The apparatus may thus be configured so that the apparatus defines at least one point or area of contact with the wall of the borehole or bore-lining tubular. In some embodiments, the apparatus may be configured so that the apparatus defines a plurality of points or areas of contact with the wall of the borehole or bore-lining tubular. In particular embodiments, the apparatus may be configured so that the apparatus defines three points or areas of contact with the wall of the borehole or bore-lining tubular. Embodiments of the invention may provide at least one of wear protection, torque reduction and/or centralisation by offsetting the body and any connected components from contacting the low side of the borehole or bore-lining tubular.

The apparatus may further comprise the body. The body may be of any suitable form or construction. The body may comprise a shaft, a mandrel or the like. The body may comprise a thick wall tubular. The body may comprise a section of drill pipe, drill collar or the like. The body may comprise a section of bore-lining tubular. For example, the body may comprise a section of casing or liner.

The body may be configured for coupling to a tubular string, for example but not exclusively a drill string, a running string, a bore-lining tubular string, a completion string, or the like. In particular embodiments, the body may be configured for coupling to the string at an intermediate position in the string. Alternatively, the body may be configured for coupling to the string at an end of the string, such as a distal end of the string.

The body may comprise a connector for coupling the body to the tubular string. The connector may be of any suitable form. The connector may, for example, comprise at least one of a mechanical connector, fastener, adhesive bond, or the like. In some embodiments, the connector may comprise a threaded connector at one or both ends of the body. In particular embodiments, the connector may comprise a threaded pin connector at a first end of the body and a threaded box connector at a second end of the body. In use, when the apparatus is run into the borehole the body may be coupled to the string so that the first end having the threaded pin connector is provided at the distalmost or downhole end of the body and so that the second end having the thread box connector is provided at the uphole end of the body.

The body may be hollow. For example, the body may comprise a longitudinal bore extending at least partially therethrough. In use, the longitudinal bore may facilitate the flow of fluid through the apparatus.

The traction member may be rotatably mountable on the body so that the traction member rotates around the body. In use, the traction member may roll around an outer circumferential surface of the body. In particular embodiments, the traction member may be configured to be directly mounted on the body. In other embodiments, the traction member may be configured to be indirectly mounted on the body.

To facilitate relative rotation between the traction member and the body, the apparatus may comprise a bearing between the traction member and the body and the traction member may be mountable on the body via the bearing. At least part of the bearing may be formed on, or coupled to, the traction member. At least part of the bearing may be formed on, or coupled to, the body. The bearing may be of any suitable form or construction. The bearing may comprise a fluid lubricated bearing and may, for example, comprise a marine type cutlass bearing. The bearing may comprise a bearing sleeve for mounting on the body. The bearing sleeve may be formed on the traction member. The body may define a bearing journal. For example, an outer section of the body may be machined or otherwise formed to define a bearing journal onto which the traction member is rotatable mountable. Beneficially, where the body defines the bearing journal, this provides structurally reliable attachment means for the traction member whilst maintaining the structural integrity of the body. In other embodiments, the body and bearing may comprise separate components and the body may be configured to receive the bearing.

The traction member may be rotatably mountable on the body so that the traction member transmits force to the body. For example, the traction member may be rotatably mountable on the body so that the traction member transmits the longitudinal force component to the body to urge the apparatus and any coupled components along the borehole or bore-lining tubular wall.

The body may define a recess for receiving the traction member. In some embodiments, the recess may form the bearing journal. In some embodiments, the recess may be configured to receive the bearing. The provision of a recess in the body facilitates coupling between the traction member and the body and may permit forces to be transmitted from the traction member to the body and the string.

The body may be configured to receive the traction member about the outer circumferential surface of the body.

The apparatus may comprise a single traction member.

In particular embodiments, the apparatus may comprise a plurality of traction members. The number and arrangement of the traction members may be configured to provide the points or areas of contact with the wall of the borehole or bore-lining tubular.

The traction members may be configured for location along the length of a section of the body.

In particular embodiments, a plurality of the traction members may be configurable for location on the body, wherein the traction members are longitudinally spaced along the length of the body. Beneficially, axially spacing the traction members may distribute the load exerted by the apparatus on the surrounding borehole or bore-lining tubular, and may reduce or prevent damage to the borehole or bore-lining tubular which may otherwise occur were the tool to exert point loads on the borehole or bore-lining tubular. This may be particularly beneficial where the apparatus is located with a weak or unconsolidated section of borehole which may be susceptible to collapse.

The apparatus may further comprise at least one collar for securing the traction member or members on the body. The collar or collars may form an interference fit with the body. Alternatively, or additionally, the collar or collars may be threaded or keyed to the body.

In some embodiments, a plurality of the traction members may be configurable for location on the body in abutting relation to each other. One or more traction member may be configured to engage with at least one other traction member. For example, the traction member or members may comprise a traction member coupling arrangement for coupling the traction member to at least one other traction member. The traction member coupling arrangement may comprise at least one of a mechanical coupling arrangement, an adhesive bond, a quick connect device, male and female connector or the like.

The traction member or members may of any suitable form or construction.

The traction member may comprise a sleeve or collar configured for location around the body, or body recess.

The sleeve may be of any suitable form or construction.

In some embodiments, the sleeve may comprise a single component.

Alternatively, the sleeve may comprise a plurality of components.

In particular embodiments, the sleeve may comprise a split sleeve. Where the traction member comprises a split sleeve or a plurality of components, a securement for securing the parts of the sleeve together may be provided. In particular embodiments, the securement may comprise one or more mechanical fasteners such as bolts. Alternatively, or additionally, the securement may comprise an adhesive bond, weld, or other any suitable means.

The traction member may comprise a radially extending rib or blade or other upset diameter portion. In use, the rib or blade may engage the wall of the borehole or bore-lining tubular. The rib or blade may be of any suitable form. In particular embodiments, the rib or blade may define a spiral configuration, either on a single traction member or in combination with at least one other traction member. Beneficially, a spiral configuration may assist in uplift or movement of drill cuttings lying on the low side of the borehole, for example.

The traction member may comprise a single rib or blade. Alternatively, the traction member may comprise a plurality of ribs or blades. In particular embodiments, the traction member may comprise three ribs or blades. Where the traction member comprises a plurality of ribs or blades, these may be located at circumferentially spaced positioned around the traction member. The number and arrangement of the traction members and the number and arrangement of the ribs may be configured to provide the desired points or areas of contact with the wall of the borehole or bore-lining tubular. By way of example, in particular embodiments the apparatus may comprise six traction members, each traction member having three blades provided at 120 degrees around the circumference of the traction member.

Longitudinal cut out portions may be provided in the upset diameter portion of the body to provide fluid and/or debris bypass when the apparatus is in operation.

The rib or blade may be integrally formed with the sleeve. Alternatively, the rib or blade may comprise a separate component formed or coupled to the sleeve.

At least part of the traction member may comprise, be formed with or receive a hard faced material or may be subject to a surface hardening treatment. Any suitable hard faced or treatment may be utilised. In particular embodiments, the hard faced material or treatment may comprise one or more of hard banding, carbide inserts, polycrystalline diamond compact, or the like The provision of a hard faced material or hardening traction member may be particularly beneficial where the apparatus is used in an open hole environment, that is the apparatus is configured to engage the wall of an uncased or lined borehole, as this may protect the traction member from damage caused by the borehole environment, including for example but not exclusively drill cuttings in the bore, borehole formations, and/or fluid passage through the annulus between the apparatus and the borehole. Alternatively, or additionally, the provision of hard-facing material or surface hardening treated areas may also enhance grip. In some embodiments, the provision of hard-facing material or surface hardening treated may facilitate a reaming action.

At least part of the traction member may comprise, be formed with or receive an elastomeric or other resilient material. Any suitable elastomeric or resilient material may be utilised. In particular embodiments, the material may comprise hydrogenated nitrile butadiene rubber or polyurethane material, although any suitable material may be utilised. The provision of an elastomeric or resilient material may be particular beneficial where the apparatus is used in a bore-lining tubular, such as casing, as this may protect or other prevent or mitigate damage to the bore-lining tubular.

As described above, the traction member is mountable on the body so as to define a skew angle relative to a longitudinal axis of the body and is configured to engage a wall of a borehole or bore-lining tubular to urge the apparatus along the wall of the borehole or bore-lining tubular on rotation of the traction member relative to the body. The skew angle may be provided by any suitable means.

For example, the traction member may be formed to define the skew angle. Alternatively, or additionally, where a bearing sleeve is provided, the bearing sleeve may be formed to define the skew angle. Alternatively, or additionally, the body may define the skew angle. In particular embodiments, the body defines the skew angle and the body may be formed or otherwise constructed to form a plurality of skewed journals for receiving a plurality of traction members. It is envisaged that the body may be formed in a similar way to a multi-cylinder internal combustion engine crank shaft, with very slight offset on the cranks and these cranks being very slightly angled or skewed. Beneficially, the provision of a single unit provides structurally reliable attachment means for the traction member or traction members whilst maintaining the structural integrity of the body.

The angle of skew of the traction member may be selected to urge the apparatus along the wall of the borehole at a selected rate. The skew angle could be relatively small, for example 1 degree or less than one degree. As the rotational speed of rotary drilling assemblies is normally limited between 100 and 200 rpm and the borehole diameter of the section drilled through the reservoir is generally but not always 8.5" (about 216 mm) or less, and the drilling rate of penetration generally below 100 ft. per minute (about 0.51 meters per second), then the skew angle required to provide efficient forward traction and transport system is relatively small, for example 1 degree or less. In particular embodiments, the skew angle may be 0.5 degrees. By way of example, half a degree skew angle may provide a forward thrust speed of 170 ft. per hour at 150 rpm approximately. In other embodiments, the skew angle may be between 1 degree and 5 degrees. In other embodiments, the skew angle exceeds 5 degrees. However, in some circumstances it may be desirable for the skew angle to be higher.

The direction of skew angle of the traction member may be selected to urge the apparatus in the selected direction along the wall of the borehole. For example, the direction of skew angle may be selected to urge the apparatus in the forward or downhole direction. In particular embodiments, is it envisaged that the apparatus will be configured so that right hand rotation of the body will result in the apparatus being urged in the forward or downhole direction. However, the direction of skew angle may alternatively be selected to urge the apparatus in the reverse or up hole direction. In order to provide efficient reverse traction, it is envisaged that a reverse skew angle may be in the range of about 3 degrees to about 5 degrees.

As described above, the traction member may be mountable on the body so that the traction member is offset from a central longitudinal axis of the body. The offset may be provided by any suitable means. In particular embodiments, the offset may be provided by the body. Accordingly, the body may be formed or otherwise constructed to form a plurality of offset and skewed journals for receiving a plurality of traction members.

It will be recognised that the apparatus may take a number of different forms.

In some embodiments, the apparatus may be passive. In other embodiments, the apparatus may be configured to be non-passive or activatable, that is configured so as to have a first, passive configuration and a second, active, configuration in which the traction member urges the apparatus along the inner wall of the borehole or bore-lining tubular. The apparatus may be configured so that the traction member is offset from the borehole wall in the passive configuration. The traction member may be mounted on the body so that the traction member does not contact the inner wall of the borehole in the passive configuration, the traction member only contacting the borehole wall when in the second, active, configuration.

Alternatively, the apparatus may be configured so that the traction member contacts the borehole wall in both the passive and active configurations. The traction member may thus assist in reducing or mitigating rotational friction forces in both the passive and active configurations.

The apparatus may further comprise an activation arrangement for moving the traction member from the passive configuration to the active configuration. The apparatus may be configured so that the traction member moves radially, for example by 3 to 5 mm, when moving from the passive configuration to the active configuration. The activation arrangement may be configured to urge the traction member into contact with the borehole wall. Alternatively, where the apparatus is configured so that the traction member contacts the borehole wall in the passive configuration, the activation arrangement may urge the traction member further into contact with the borehole wall.

The activation arrangement may be of any suitable form. The apparatus may comprise at least one of a hydraulic activation arrangement, a pneumatic activation arrangement, and/or mechanical activation arrangement.

The activation arrangement may be configured to selectively expose the traction member to a differential pressure. The differential pressure may comprise the difference between the internal pressure of the apparatus, which may be applied from surface, and the annulus pressure, that is the pressure between the outside of the apparatus and the borehole wall. The apparatus may be configured so that the differential pressure acts on a selected area of the traction member or apparatus, the applied differential pressure multiplied by the selected area providing an activation force acting to urge the traction member from the passive configuration to the active configuration. The longitudinal component of the activation force may form a traction force for urging the apparatus along the borehole wall.

The differential pressure may be of any suitable magnitude. For example, the differential pressure may be selected to be 1000 psi. The selected area may be of any suitable area. For example, the selected area may be around 5 square inches. Thus, for a differential pressure of 1000 psi and a selected area of 5 square inches, the activation force would be 5000 lbs force. Taking frictional forces into account, a activation force of 5000 lbs force may be converted into a traction force in the region of 3000 to 4000 lbs force. The apparatus may be configured so as not to exceed the force at which expansion of any surrounding tubulars, such as a section of casing, will occur.

In particular embodiments, the activation arrangement may comprise a sleeve adapted for location within the body throughbore. In use, the sleeve may be configured for axial/longitudinal movement relative the body to permit fluid access to urge the traction member from the passive configuration to the active configuration. In some instances, this may involve urging the traction member radially outwards to contact the bore wall. Alternatively, or additionally, this may involve urging the traction member from a position in which the traction member is coaxial with the longitudinal axis of the body to a skewed position relative to the longitudinal axis.

The sleeve may be of any suitable form. For example, the sleeve may comprise a collet sleeve having a number of collet fingers. One or more of the collet finger may comprise a tab for engaging a groove provided in the body throughbore. Alternatively, or additionally, the sleeve may comprise a ball retent sleeve or the like.

The activation arrangement may further comprise a shear pin or other suitable device for holding the sleeve within the body. In use, the sleeve may be released by sending a control element, such as an activation dart or ball, down through the drill string to seat on the sleeve. The activation arrangement may further comprise a rupture disk or the like, for coupling to the control element. In use, the rupture disk may permit the control element, such as the dart or ball, to be run into the sleeve. In use, applying fluid pressure above the control element, dart or ball may shear the shear pin and release the sleeve. The sleeve may be caught by a catcher or shoulder provided in the body throughbore. Movement of the sleeve may permit the pressure differential to act on the traction member from the passive configuration to the active configuration. Further application of fluid pressure may rupture the rupture disk and permit fluid access below the apparatus, for example to another apparatus according to the present invention or another tool in the drill string.

In some embodiments, one or more traction member may comprise a roller or journal. The roller may be adapted for rotation relative to the body on a roller bearing shaft. The traction member may be of sufficient diameter that the central longitudinal axis of the body lies within the diameter of the traction member. The axis of the skewed traction member may lie within less than half its diameter from the central longitudinal axis of the body. The traction member may be constructed at least in part from an elastomeric or polymeric material, although any suitable material may be used where appropriate.

A recess or pocket may be provided in the body, in particular but not exclusively, the blade or upset diameter portion of the body. The recess may be adapted to receive the traction member.

The traction member may be adapted for mounting in the body directly. Alternatively, and in preferred embodiments, the apparatus may further comprise a carrier into which the traction member is rotatably mounted. Where a carrier is provided, the apparatus may be configured so that the differential pressure acts on a selected area of the carrier to urge the traction member from the passive configuration to the active configuration.

A seal element may be provided between the carrier and the body. The seal element may be of any suitable form. The seal element may be provided between the carrier and the body so as to permit movement of the carrier in a radial direction. The seal element may comprise at least one of a urethane rubber material, hydrogenated nitrile material or swelling elastomer material.

The traction member may be mounted in the body by any suitable means. For example, the traction member may be secured by means of one or more tapered retention block. The taper of the retention block or blocks may be sufficient to secure the blocks to the body. In particular embodiments, the retention blocks may be secured by a latch lock. The retention blocks may be further secured in place by a fastener such as at least one cap bolt, although any suitable means may be used where appropriate.

The bearing shaft and retention blocks may form a roller assembly of which there may be a number, circumferentially spaced around the upset section of the cylindrical tool body.

The traction member, for example the roller mounted on the roller bearing shaft, may be provided with one or more pressure-compensated radial bearings. Lubricant, for example pressure-compensated lubricant, may be held within a reservoir in the retention block, or one or more of the retention blocks where more than one block is provided. The reservoir may comprise a pressure-compensated, modular, positive pressure reservoir contained within the centre portion of the retention block. Beneficially, the internal volume of the retention block may provide the facility to contain substantially more lubricant than is currently provided in rolling element tools of equivalent size, thereby increasing the life of the radial bearings in operation.

The lubricant may be directed to the bearing by any suitable means. For example, the lubricant held within the positive pressured reservoirs may be fed into a drilled central bore at either end of the bearing shaft and fed to the bearing by means of one or more cross-drilled hole communicating between the drilled central bore and lubrication grooves machined on the external diameter of the bearing shaft.

The lubricant may be retained within the bearing section of the traction member by at least one rotary seal. In particular embodiments, the lubricant may be retained within the bearing section of the traction member by a number of rotary seals located at either end of the traction member between an external diameter of the bearing shaft and an internal diameter of the traction member.

The end thrust loads experienced by the traction member or members due to the traction forces may be supported by a bearing. The bearing may, for example, comprise one or more internal thrust bearings. The internal thrust bearing or bearings may be contained within the pressure compensated area of the traction member. Alternatively, the bearing may comprise one or more mud lubricated thrust bearing situated at an, or either, end of the traction member and outwith the sealed pressure compensated area of the traction member, that is between the traction member and the bearing faces on the retention blocks.

The apparatus may further comprise at least one further traction member. The further traction member may comprise a fixed traction member, that is, a traction member not having passive and active configurations. It is envisioned that the further traction member may have either no skew or a forwardly-directed skew angle so that the further traction member or members assist in urging the apparatus downhole.

Accordingly, the apparatus may comprise one or more passive traction member and one or more activatable traction member capable of moving from a passive configuration to either increase forward thrust or provide reverse thrust. Since the skew angle of the reverse-directed traction member or members may be selected to be greater than the angle of the forward-directed traction member or members, then reverse thrust may still be achieved in the presence of forward-directed traction members.

The apparatus may form, or form part of, a downhole stabiliser.

According to a further aspect of the present invention, there is provided an assembly comprising:

a borehole tubular; and at least one apparatus according to the first aspect of the invention The assembly may comprise a single apparatus. In particular embodiments, the assembly may comprise a plurality of apparatus.

The assembly may comprise a plurality of tubulars and may comprise a drill string for drilling or extending a wellbore, a running string, a completion string or the like.

The assembly may be configured to be urged along the inner wall of the borehole or bore-lining tubular in response to rotation of the body. Rotation of the body may be effected at least partly by rotating the drill string or running string to which the body may be coupled in use. Alternatively, or in addition, the assembly may comprise a downhole drive and rotation of the body may be effected at least partly by the downhole drive. The downhole drive may be of any suitable form or construction. For example, the downhole drive may comprise a fluid powered drive, such as mud motor, hydraulic motor, or the like. Alternatively, the downhole drive may comprise an electric motor.

The assembly may comprise a hanger, such as a liner hanger.

The assembly may comprise a device for selectively permitting access to the annulus. In some embodiments, the device may comprise an in-flow control device or valve. In some embodiments, the device may comprise a sandscreen or the like.

The assembly may comprise a swivel.

By providing a number of apparatus in combination, one or more of the apparatus' may be configured to urge the assembly in a reverse or out of hole direction and one or more of the apparatus' may be configured to urge the assembly in a downhole direction, the apparatus' selectively activated to either drive the assembly in a forward or reverse direction as required.

At least one of the apparatus' may be arranged at selected downhole locations, so as to provide a traction force at a selected location of the borehole. For example, one or more apparatus may be located at or near a heel section of a high angle or horizontal borehole in order to overcome the capstan effect. Alternatively, one or more apparatus may be provided adjacent a distal leading end of the assembly.

Alternatively, or in addition, the assembly may be configured to provide increased thrust in a selected direction and/or provide different amounts of thrust at different points along the length of the assembly. For example, the assembly may be configured to include apparatus comprising activatable traction members in sections where greater traction or reverse traction is desired. The assembly may alternatively or additionally be configured to include apparatus comprising passive traction members. In particular, apparatus comprising passive traction members distributed along the length of the body may be utilised in weak sections of the borehole or damaged sections of bore-lining tubular in which it is desired to provide the advantages of the present invention but for which the activatable traction members may not be suitable.

It will be recognised that apparatus and assemblies according to embodiments of the present invention may be configurable for use within a bore-lining tubular or string of bore-lining tubulars, for example a cased borehole or within an open borehole or other uncased borehole section.

Other aspects of the invention relate to methods of providing traction, the reduction of downward drag and of rotational torque in rotary drilling assemblies used to drill high angle or horizontal wellbores.

Embodiments of the present invention beneficially provide a transport mechanism for moving a drill string or running string along a high angle or horizontal borehole and may eliminate or reduce the need to transmit longitudinal forces from surface. When configured to urge the apparatus in a reverse direction, embodiments of the invention may permit controlled movement of the drill string in a reverse direction without the risk of the drill string becoming stuck due to the capstan effect. Also, when configured to urge the apparatus in a forward direction, embodiments of the invention may reduce the requirement for compressive forces transmitted through the drilling tubulars from higher up in the borehole or from surface, eliminating or reducing the detrimental effects of "stick slip" to provide effective controllable weight on bit when drilling in a high angle and horizontal borehole. Embodiments of the present invention also substantially improve on the existing prior art by combining the beneficial aspects of both fixed blade and non-rotating stabilisers whilst eliminating the negative aspects of both.

It should be understood that the features defined above in accordance with any aspect of the present invention or below in relation to any specific embodiment of the invention may be utilised, either alone or in combination, with any other defined feature, in any other aspect of the invention.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
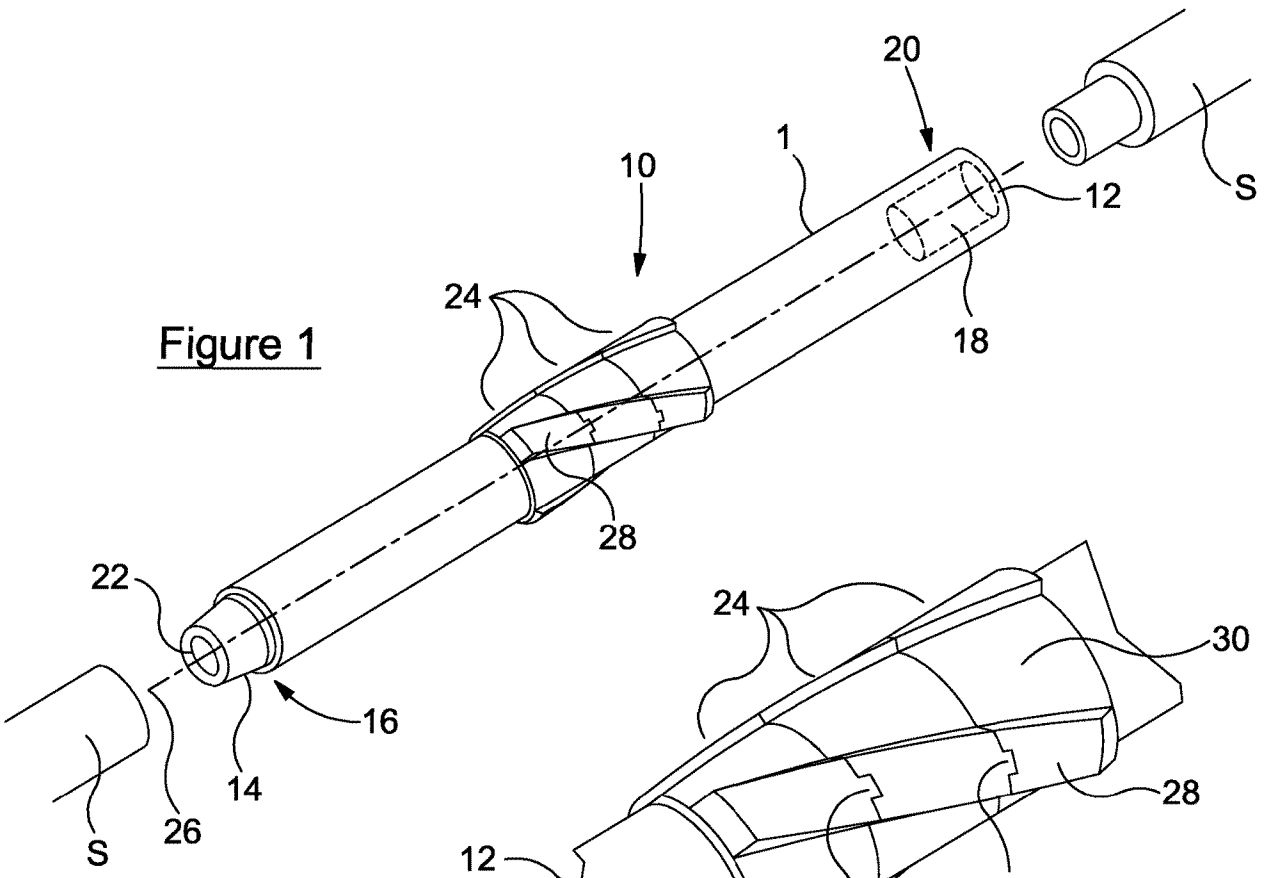
FIG. 1 shows an isometric perspective view of an apparatus according to an embodiment of the present invention.
Figure 2:
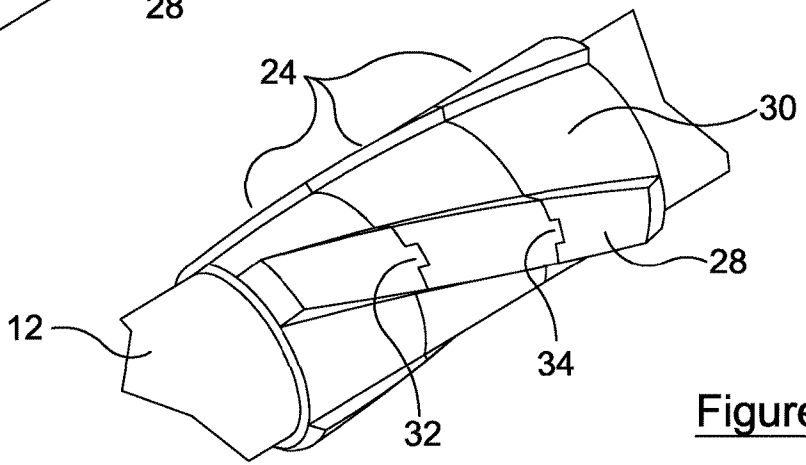
FIG. 2 shows an enlarged view of the highlighted part of FIG. 1.

Referring first to FIGS. 1 and 2 of the drawings, there is shown an apparatus 10 according to an embodiment of the present invention. In the embodiment shown, the apparatus 10 takes the form of a centraliser device or tool and the apparatus 10 forms an integral part of a string of rotational tubulars, such as a drilling or workover string S, for use in a borehole.

In use, the apparatus 10 provides thrust and a transport mechanism for urging the apparatus 10 and connected string S through the borehole. The apparatus 10 additionally provides centralisation of the string S when run and rotated through the borehole, torque reduction and prevents wear to the string S.

As shown in FIG. 1, the apparatus 10 comprises a shaft or mandrel 12. A threaded pin connector 14 is provided at a first end 16 of the mandrel 12 and a threaded box connector 18 is provided at a second end 20 of the mandrel 12. The threaded pin connector 14 and threaded box connector facilitate connection between the ends 16, 20 of the mandrel 12 and the string S. A central throughbore 22 is provided in the mandrel 12 and, in use, the throughbore facilitates the flow of fluid through the apparatus 10 and through the string S.

One or more traction members in the form of rollers 24 are mounted on the mandrel 12. In the embodiment shown in FIGS. 1 and 2, three rollers 24 are provided in abutting relationship on the mandrel 12. The rollers 24 are mounted in such a way as to provide both offset and skew or angle with respect to a central longitudinal axis 26 of the mandrel 12. As can be seen from the figures, the rollers 24 have a bladed configuration and in the embodiment shown the rollers 24 comprises spirally arranged blades 28. In use, the blades 28 provide stabilisation against the inner wall of the borehole or casing whilst maintaining clearance and a flow area 30 between the blades 28 which allows for the flow of return fluids up the annular space between the mandrel 12 and the borehole or casing internal diameter.

Referring in particular to FIG. 2, it can be seen that some of the rollers 24 are provided with a key 32 and a slot 34 at respective ends of the blades 28 in order to maintain alignment of the blades 28 relative to each other.

Figure 4:
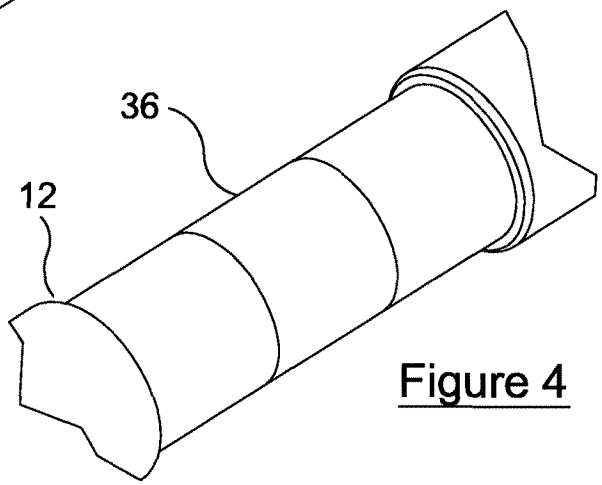
FIG. 4 shows an enlarged perspective view of the highlighted part of FIG. 3.
Figure 3:
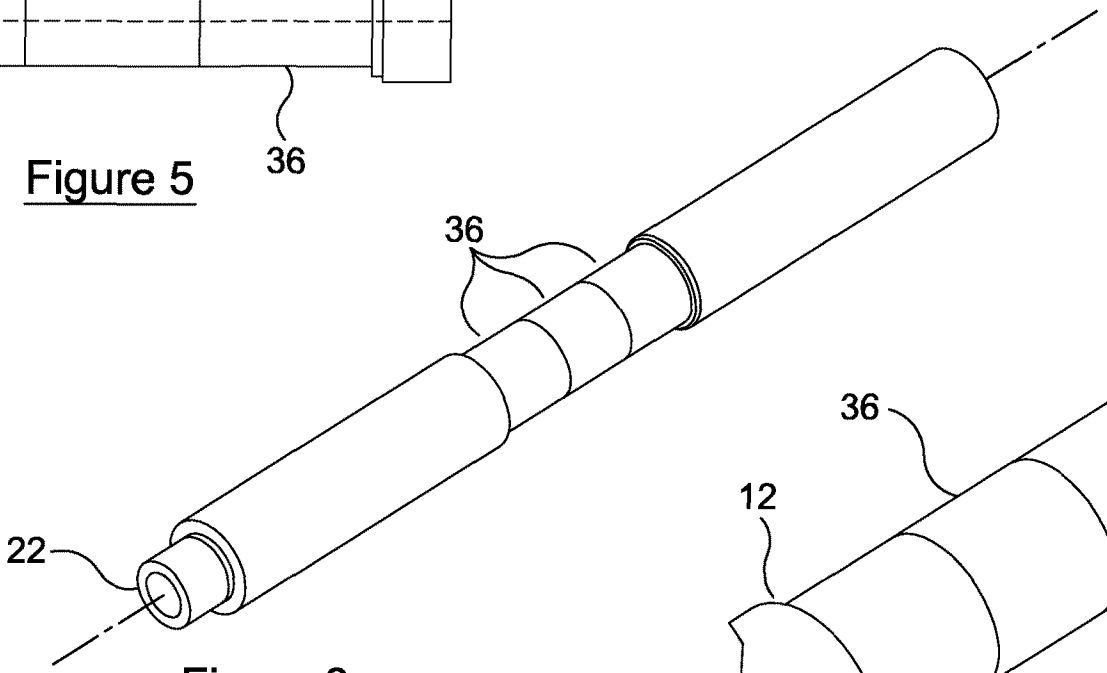
FIG. 3 shows an isometric perspective view of the apparatus shown in FIGS. 1 and 2, with traction members removed and showing the offset and skewed journals.
Figure 5:
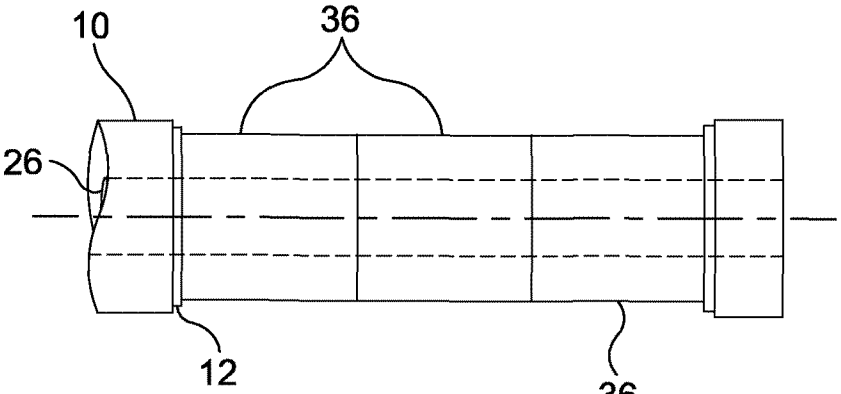
FIG. 5 shows an enlarged side elevation view of the highlighted part of FIG. 3.

FIGS. 3, 4 and 5 of the drawings show the apparatus 10 with rollers 24 removed. As shown, a number of offset and skewed journals 36 are machined or otherwise formed in the outer circumferential surface of the mandrel 12, the journals 36 permitting the rollers 24 to be rotationally mounted to the mandrel 12. As can be seen most clearly in FIG. 5, the journals 36 are machined so as to provide an offset and skew with respect to the mandrel axis 26. The provision of offset and skewed rollers 24 introduces a longitudinal force component to the interaction between each roller 24 and the wall of the borehole or bore-lining tubular which acts to urge the apparatus 10 along the borehole or bore-lining tubular. In use, the rollers 24 roll in a helical path rather than a circumferential path around the inside of the borehole or bore-lining tubular wall. This rolling helical path has the effect of transporting the apparatus 10 and the connected string S along the wall of the borehole or bore-lining tubular.

In the embodiment shown, three journals 36 are provided and are arranged at 120 degree radial spacing about the axis 26 of the mandrel 12 such that the rollers 24 mounted on the journals 36 will make three point contact on the internal diameter of the borehole or casing in which they are run. However, it will be recognised that the number of journals, their offset and skew or angle and their angular displacement about the axis 26 may be varied. Also, while the embodiment shown involves machining the journals 36 into the mandrel 12, the journals 36 may alternatively be provided as separate components or with offset and skew or angle incorporated into them.

Figure 7:
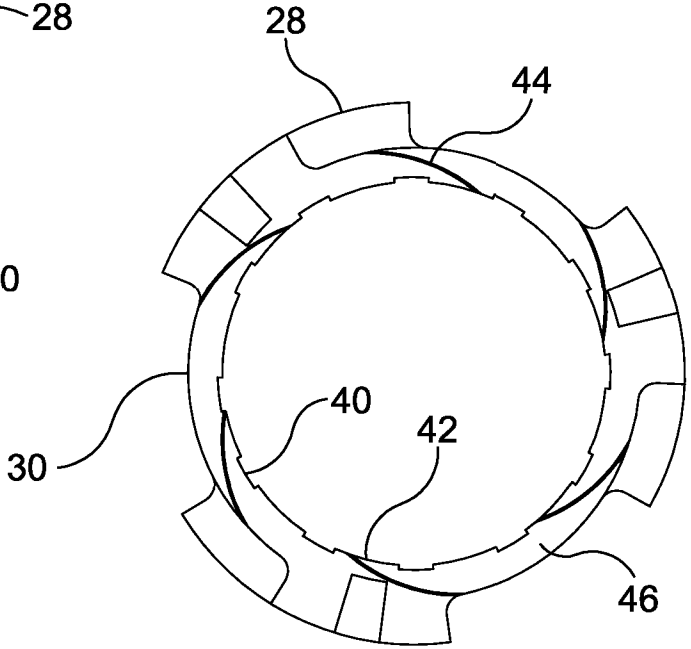
FIG. 7 shows an end view of the traction member shown in FIG. 6.
Figure 6:
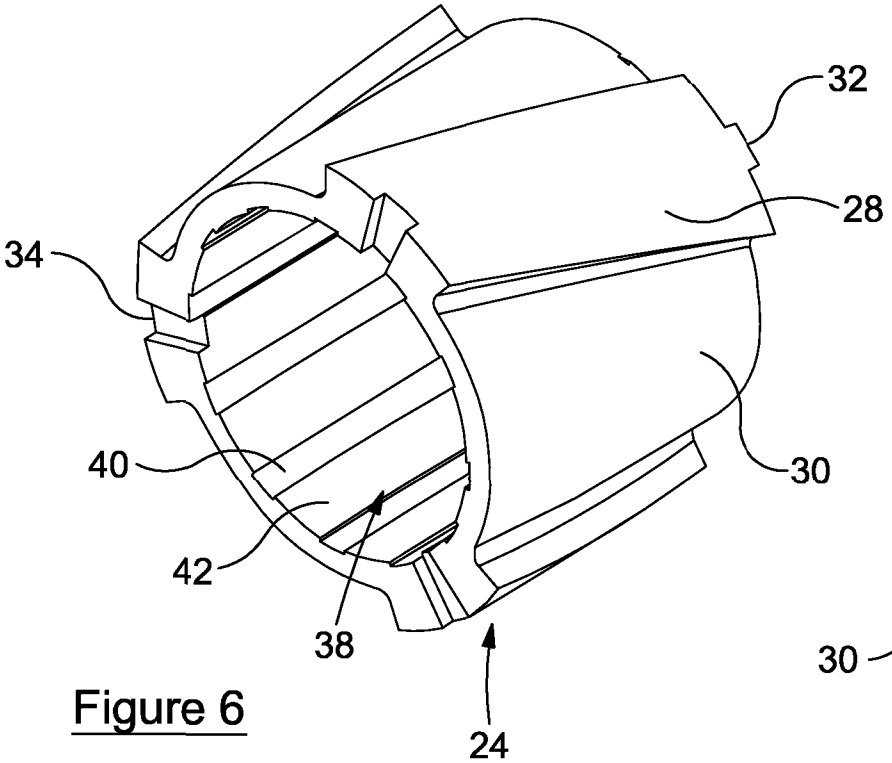
FIG. 6 shows an isometric perspective view of a traction member.
Figure 9:
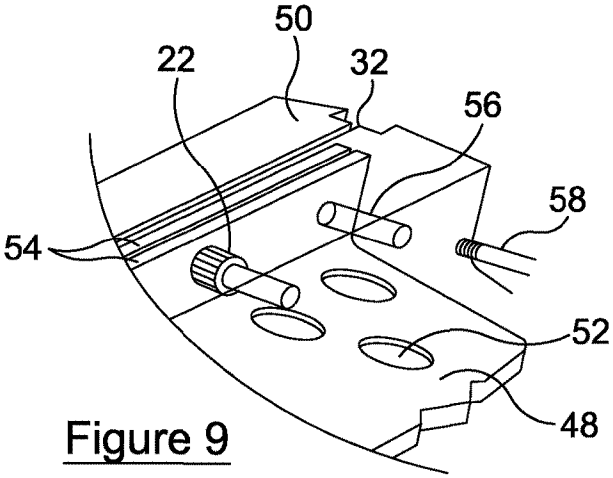
FIG. 9 shows an enlarged view of the highlighted part of FIG. 8.

Referring now to FIGS. 6 and 7 of the drawings, there are shown perspective and end views respectively of a roller 24 according to an embodiment of the invention. In the embodiment shown, the roller 24 is manufactured from a reinforced polymer or elastomeric material such as urethane or nitrile rubber (HNBR).

As described above, and as shown in FIGS. 6 and 7, the roller 24 is provided with a number of radially extending blades 28 which, in use, engage the wall of the borehole or bore-lining tubular and urge the apparatus 10 through the borehole or bore-lining tubular. The key 32 and slot 34 are also shown, these maintaining blade alignment when two or more rollers 24 are mounted on the mandrel 12.

As shown most clearly in FIG. 6, the inner surface 38 of the polymer or elastomeric material of the roller 24 is provided with flutes 40 and pads 42 to create a fluid lubricated bearing similar to a marine cutlass bearing. The pads 42 are sized to make a clearance running fit on the journals 36 on the mandrel 12. The flutes 40 allow free passage of fluid to cool and lubricate the radial bearing thus formed.

On the face of the roller 24, spiralled or angled grooves 44 (see FIG. 7) are formed in the polymer or elastomeric material to encourage fluid to enter the radial bearing and to cool and lubricate the pads 42 which provide a fluid lubricated thrust bearing against the mandrel 12. Although not shown in the illustrated embodiment, intermediate thrust rings may be installed between each journal 36 to form separate thrust faces.

FIGS. 8, 9, 10 and 11 show a polymer or elastomeric reinforced roller 24 where the roller 24 is split along a split line 46 which permits the roller 24 to be opened up for installation onto its respective journal 36. In the illustrated embodiment, the reinforcement takes the form of a perforated steel band 48 encapsulated within the polymer or elastomeric material 50 of the roller 24. Perforations or holes 52 are provided in the band 48 to provide a strong bond between the outer stabiliser section and the inner bearing section. The band 48 also provides circumferential strength to the roller 24.

Figure 10:
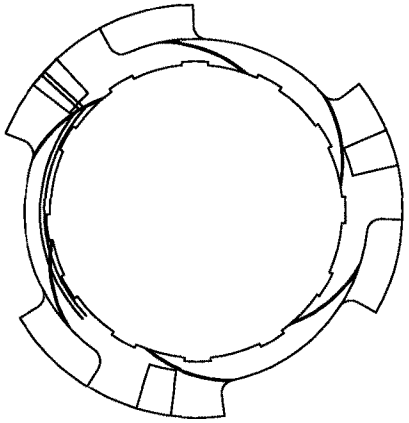
FIG. 10 shows an end view of the traction member of FIGS. 8 and 9.
Figure 8:
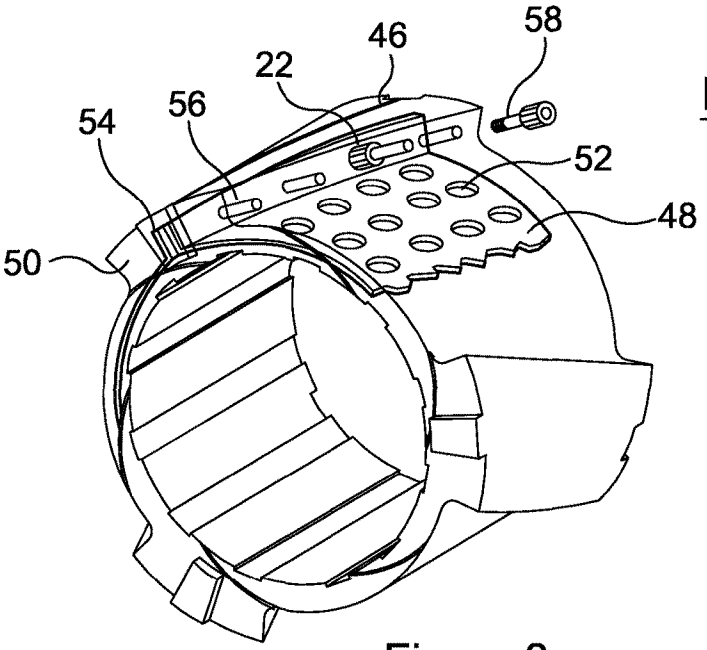
FIG. 8 shows a ghosted isometric perspective view of the traction member shown in FIGS. 6 and 7.
Figure 11:
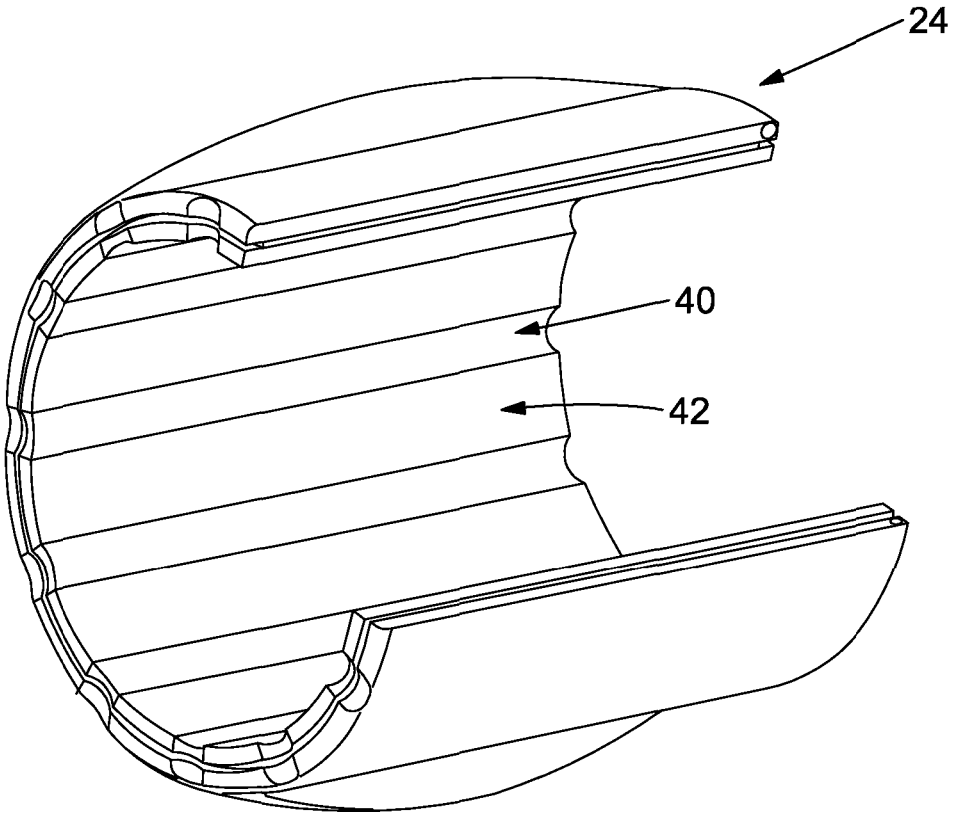
FIG. 11 shows a sectional view of the traction member shown in FIGS. 6 to 10.

As shown most clearly in FIG. 10, upset ends 54 or flanges are formed at the split line 46 and the upset ends 54 are provided with threaded bores 56 which accommodate mechanical fasteners in the form of cap screws 58. The cap screws 58 are screwed through the bores 56 formed in the polymer or elastomeric material 50 to clamp the upset ends 54 together to form the roller 24. The bores 56 are of smaller diameter than the heads of the cap screws 58 such that, when the cap screws 58 are screwed home, they deform the polymer or elastomeric material 50 of the roller 24, allowing the head of each cap screw 58 to bear against the steel upset ends 54. The polymer or elastomeric material 50 is selected to permit the material 50 to reform behind the heads of the cap screws 58 preventing rotation which could otherwise cause the cap screws 58 to back out of the bores 56.

The steel reinforcement 48, which is substantially encapsulated within the polymer or elastomeric material 50 of the roller, is exposed at its upset end 54 along the split line 46 so that when the upset ends 54 are clamped together by the cap screws 58, they form a known internal diameter of the pad sections 42. Beneficially, this provides a repeatable clearance running fit on the journals 36 to which they are attached.

In this way, it is possible to construct the apparatus 10 with offset and skewed or angled rollers 24 which will roll in a helical manner on the inner wall of the borehole or bore-lining tubular while permitting the free rotation of the mandrel 12 forming an integral part of the string S. In use, the apparatus 10 provides substantial reduction of rotational friction due to the fluid lubricated bearings, wear protection to the cased borehole due to the protective rollers 24 and thrust or transport of the string S in high angle or horizontal boreholes.

It should be understood that the embodiment described herein is merely exemplary and that various modifications may be made thereto without departing from the scope of the invention.

Referring to FIGS. 12 to 22 of the drawings, rather than being nested together on a short sub, the rollers may be mounted on mandrel in a spaced arrangement.

Figure 12:
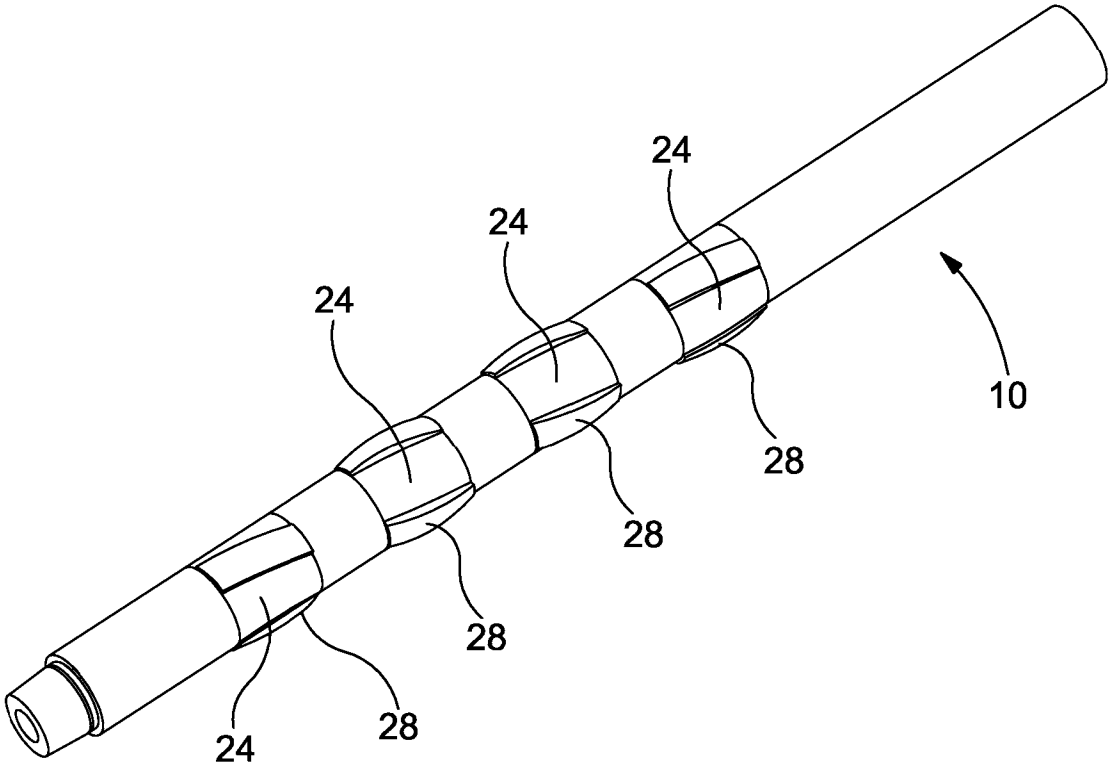
FIG. 12 shows a perspective view of an apparatus according an alternative embodiment of the present invention.

In the embodiment illustrated in FIG. 12, four offset and skewed rollers 24 are provided on the mandrel 12, each roller 24 offset e.g. at 180 degrees, so that the apparatus 10 provides at least two points of contact with the wall of the borehole or bore-lining tubular as the apparatus 10 travels along the borehole wall. In this configuration, the blades 28 on the rollers 24 would not have to be synchronised as they would have sufficient space between them to permit the passage of fluids, drill cuttings and the like past them.

Figure 14:
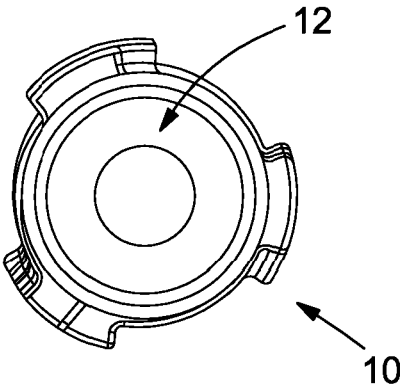
FIG. 14 shows an end view of the apparatus shown in FIG. 13.
Figure 15:
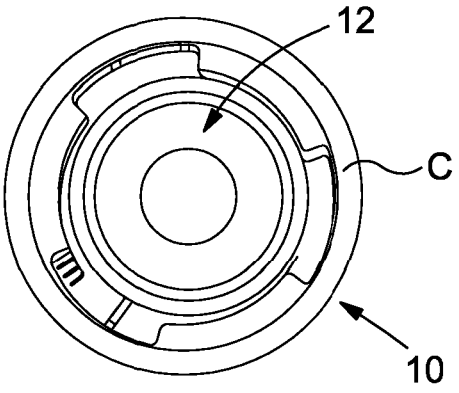
FIG. 15 shows an end view of the apparatus shown in FIGS. 13 and 14, shown within a section of casing.
Figure 13:
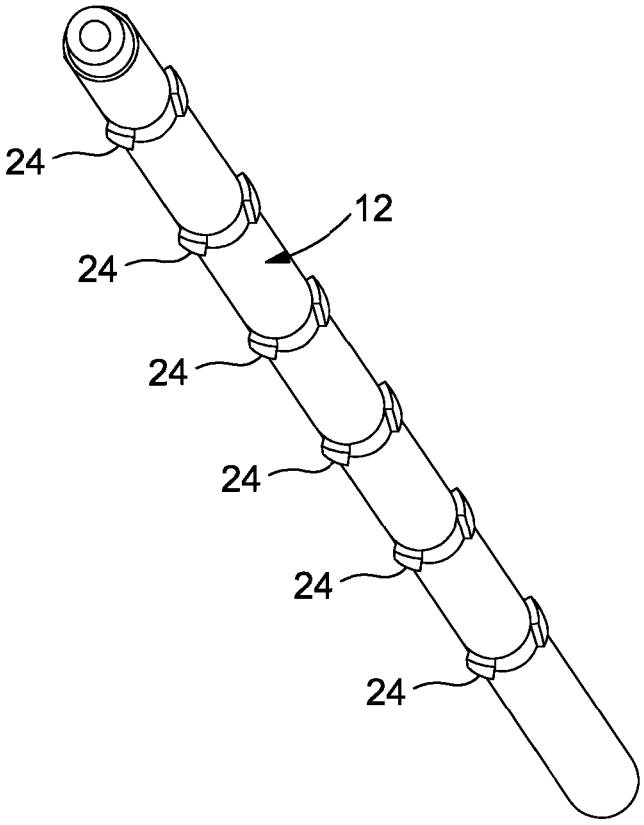
FIG. 13 shows a perspective view of an apparatus according to an another embodiment of the present invention.
Figure 16:
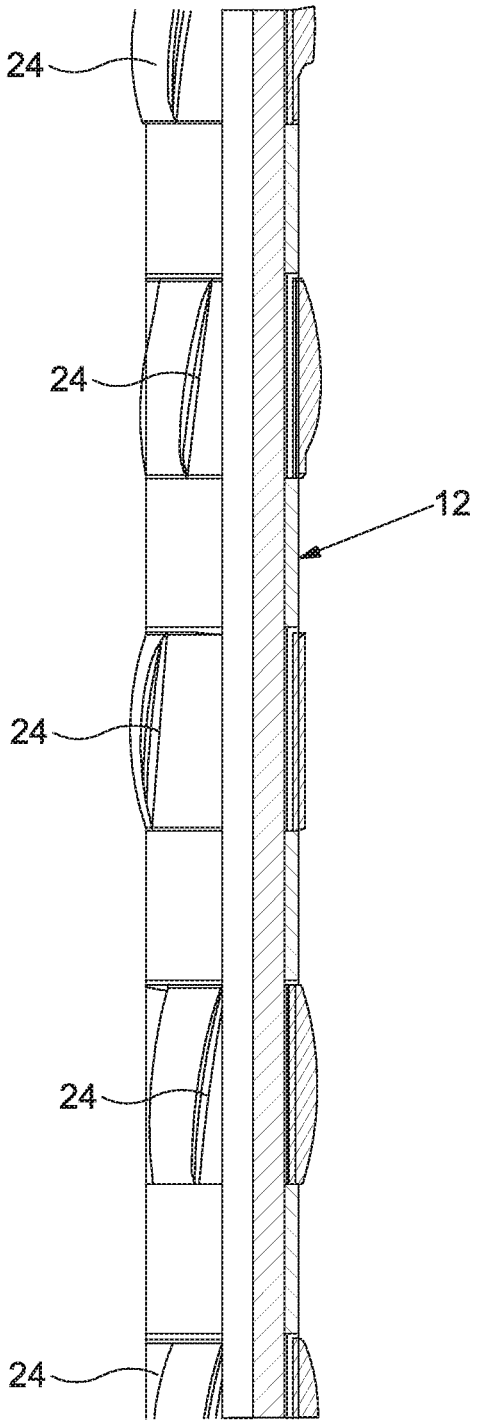
FIG. 16 shows a partial cut-away view of the apparatus shown in FIGS. 13, 14 and 15.

Another embodiment of the invention is shown in FIGS. 13 to 16 of the drawings. FIG. 13 shows a perspective view of the apparatus 10. FIG. 14 shows an end view of the apparatus 10. FIG. 15 shows an end view of the apparatus 10 shown in a section of casing C. FIG. 16 shows a partial cut away view of the apparatus 10.

In the embodiment illustrated in FIGS. 13 to 16, six offset and skewed rollers 24 are provided on the mandrel 12, each roller 24 offset e.g. at 120 degrees, so that apparatus 10 provides at least two points of contact with the wall of the borehole or bore-lining tubular as the apparatus 10 travels along the borehole wall.

In the embodiments shown in FIG. 12 and FIGS. 13 to 16, the rollers 24 are similar or identical to the rollers 24 described and shown in FIGS. 6 to 11 and are of split-sleeve type.

Figure 17:
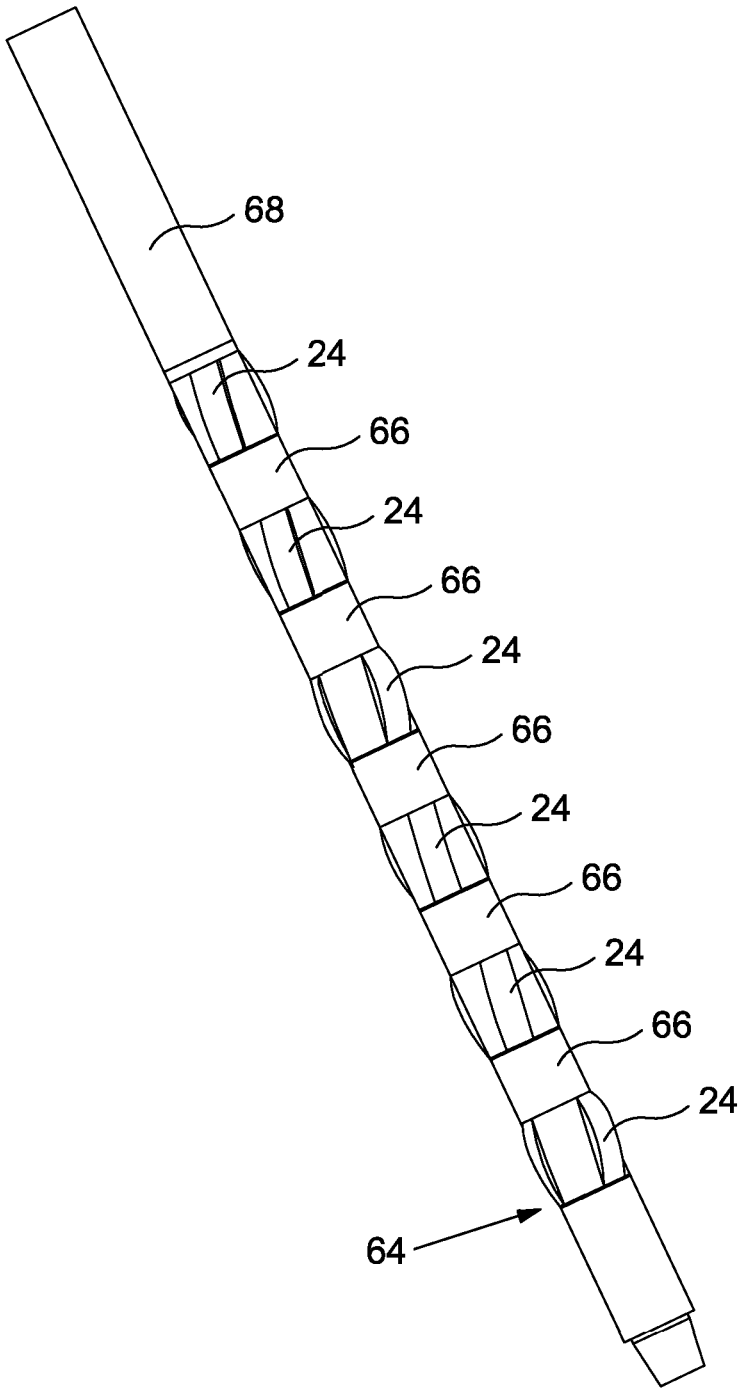
FIG. 17 shows a perspective view of an apparatus according to an another embodiment of the present invention.
Figure 18:
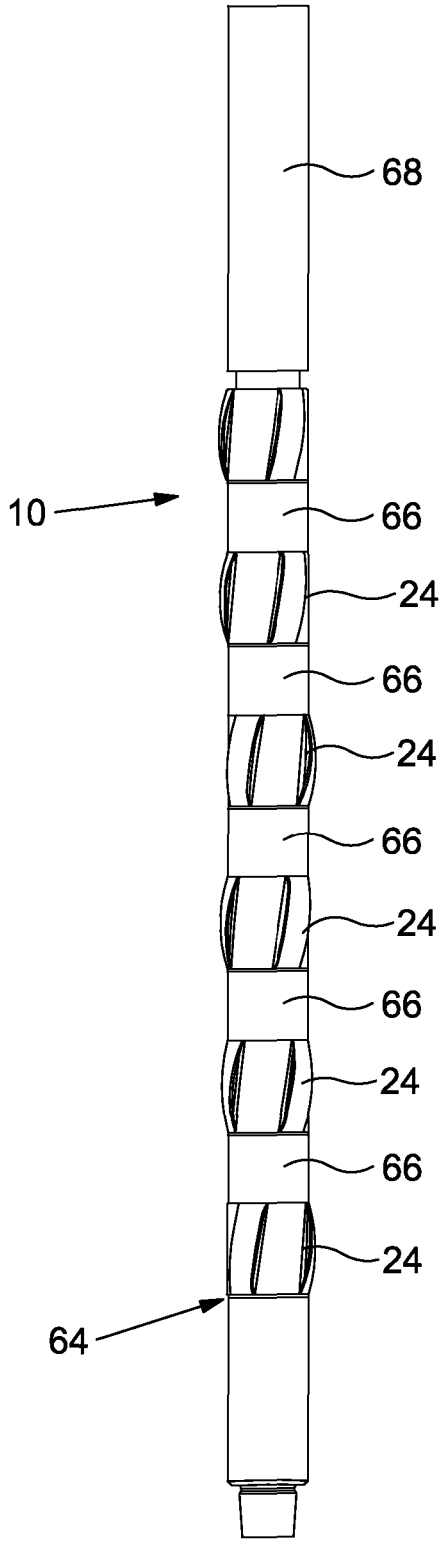
FIG. 18 shows a side view of the apparatus shown in FIG. 17.
Figure 19:
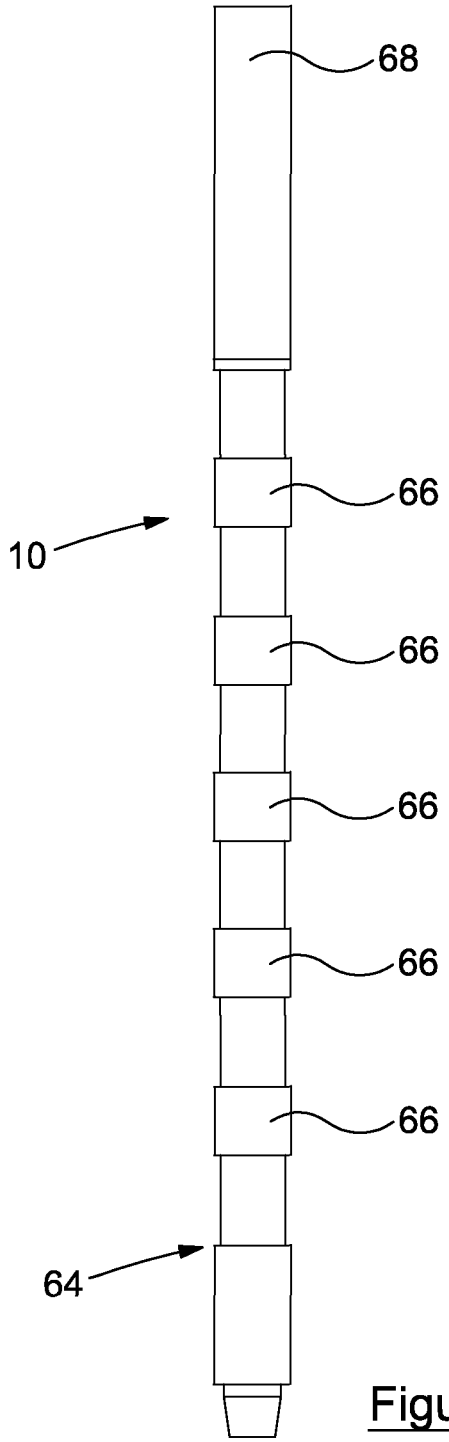
FIG. 19 shows a side view of the apparatus shown in FIGS. 17 and 18, with traction members removed.
Figure 20:
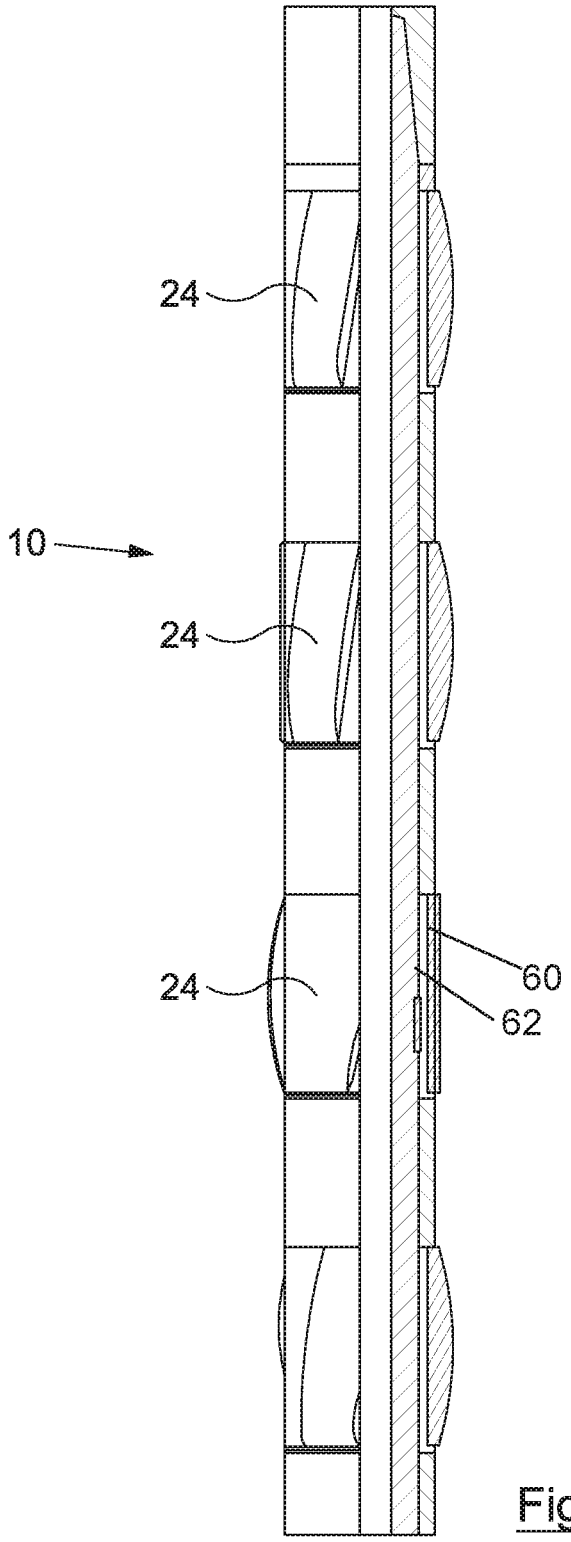
FIG. 20 shows a partial cut-away view of the apparatus shown in FIGS. 17, 18 and 19.

Referring now to FIGS. 17 to 20 of the drawings, there is shown an apparatus 10 according to another embodiment of the present invention. FIG. 17 shows a perspective view of the apparatus 10 according to this embodiment. FIG. 18 shows a side view of the apparatus shown in FIG. 17. FIG. 19 shows a side view of the apparatus shown in FIGS. 17 and 18, with traction members removed. FIG. 20 shows a partial cut-away view of the apparatus shown in FIGS. 17, 18 and 19.

In the embodiment illustrated in FIGS. 17 to 20, six offset and skewed rollers 24 are provided on the mandrel 12, each roller 24 offset e.g. at 120 degrees, so that apparatus 10 provides at least two points of contact with the wall of the borehole or bore-lining tubular as the apparatus 10 travels along the borehole wall.

However, in this embodiment the offset and skew is provided by machined skewed and offset sleeves 60 which slide over a recessed or reduced diameter section 62 of the mandrel 12. The reduced diameter section 62 extends along the length of the mandrel 12 to a point 64 above the lower threaded pin joint connection 14 sufficiently far back to allow for application of rig tongs (not shown) in operation and recuts of the pin connection in service, where required.

The sleeves 60 are keyed to the reduced diameter section 62 of the mandrel 12 at suitable angular spacings and separated from each other by shrunk fit spacers 66. of the same or similar diameter to the non-recessed section of the mandrel 12.

Beneficially, utilising rollers 24 and sleeves 60 in this way permits the apparatus 10 to be assembled at low temperature avoiding damage to elastomer bearings during assembly.

The rollers 24 and spacers 66 are held in place by a top sub 68 of the same or similar outer diameter to the unrecessed mandrel 12. This box by box threaded connection top sub 68 is of sufficient length to permit the setting of slips and making and breaking connections when the apparatus 10 is being run into and pulled out of the borehole.

In other embodiments of the invention, and referring now to FIGS. 21 to 33 of the drawings, the traction members may be activatable, that is configured so as to have a first, passive configuration in which the apparatus is not urged along the borehole wall and a second, active, configuration in which the traction member urges the apparatus along the inner wall of the borehole or bore-lining tubular.

Figure 21:
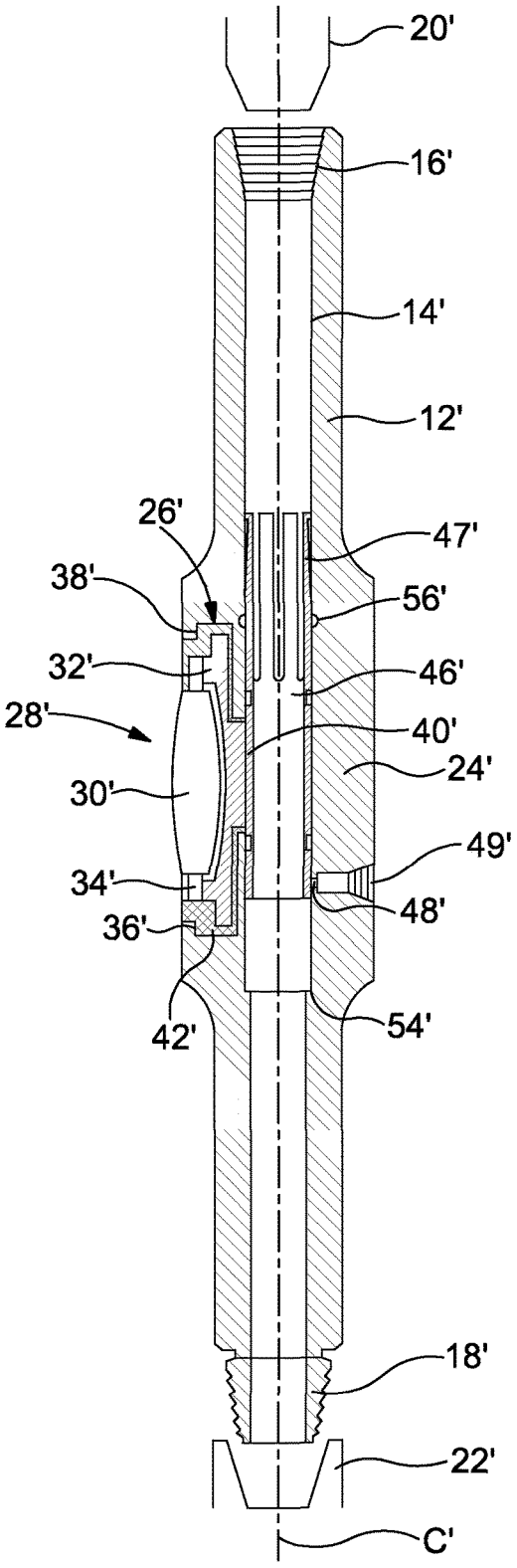
FIG. 21 is a longitudinal section view of an apparatus according to another embodiment of the present invention.

FIG. 21 shows a longitudinal sectional view of an apparatus 10' according to an alternative embodiment of the present invention, having one or more activatable traction member.

The apparatus 10' has a generally cylindrical body 12' having a throughbore 14' for passage of fluid or tools therethrough. The body 12' is provided with threaded box 16' and threaded pin 18' connections at upper and lower ends for connecting the body 12' to drill tubulars (shown schematically as 20', 22'). The apparatus 10' and drill tubulars 20', 22' form part of a drill string for use in a high angle or horizontal borehole, such as an oil or gas exploration or production wellbore, and in use the apparatus 10' provides for traction of the drill string as well as the reduction of downward drag and of rotational torque of the drill string in high angle or horizontal well bore drilling applications.

As shown in FIG. 21, the body 12' further comprises an upset diameter portion 24' in which there is provided a recess or pocket 26' for mounting a traction roller assembly 28'. The traction roller assembly 28' comprises a traction roller 30 mounted on a carrier 32' via a bearing shaft 34'. The traction roller 30 is mounted at an offset radial position from a central longitudinal axis C' of the body 12' and the diameter of the traction roller 30' is such that the roller 30' does not extend beyond the central axis C'. In the embodiment shown, the traction roller 30' comprises a barrel roller, although it will be recognised that the roller 30' may be of any suitable configuration.

The carrier 32' has a shoulder 36' shaped to engage a corresponding shoulder 38' of the pocket 26', preventing removal of the roller assembly 28' from the pocket 26'.

In the embodiment shown in FIG. 21, an inner surface 40' of the carrier 32' may be exposed to fluid in the throughbore 14', so that the carrier 32' may be urged in a radially outward direction relative to the pocket 26' from a first, passive configuration in which the roller 30' does not contact the inner wall of the borehole to a second, active configuration in which the roller 30' engages the inner wall of the borehole.

A bonded elastomer element 42' is provided between the carrier 32' and the pocket 26', the bonded elastomer element 42' providing a seal between the carrier 32' and the throughbore 14' in use, while also permitted a degree of movement of the carrier 32' between the passive and active configurations.

Only a single roller assembly 28' and pocket 26' are shown in the sectional view of FIG. 21. However, and referring now also to FIG. 22 which shows a perspective view of the apparatus 10', the apparatus 10' preferably comprises three pockets 26' and three roller assemblies 28' circumferentially spaced at 120 degrees around the body 12'.

Figure 22:
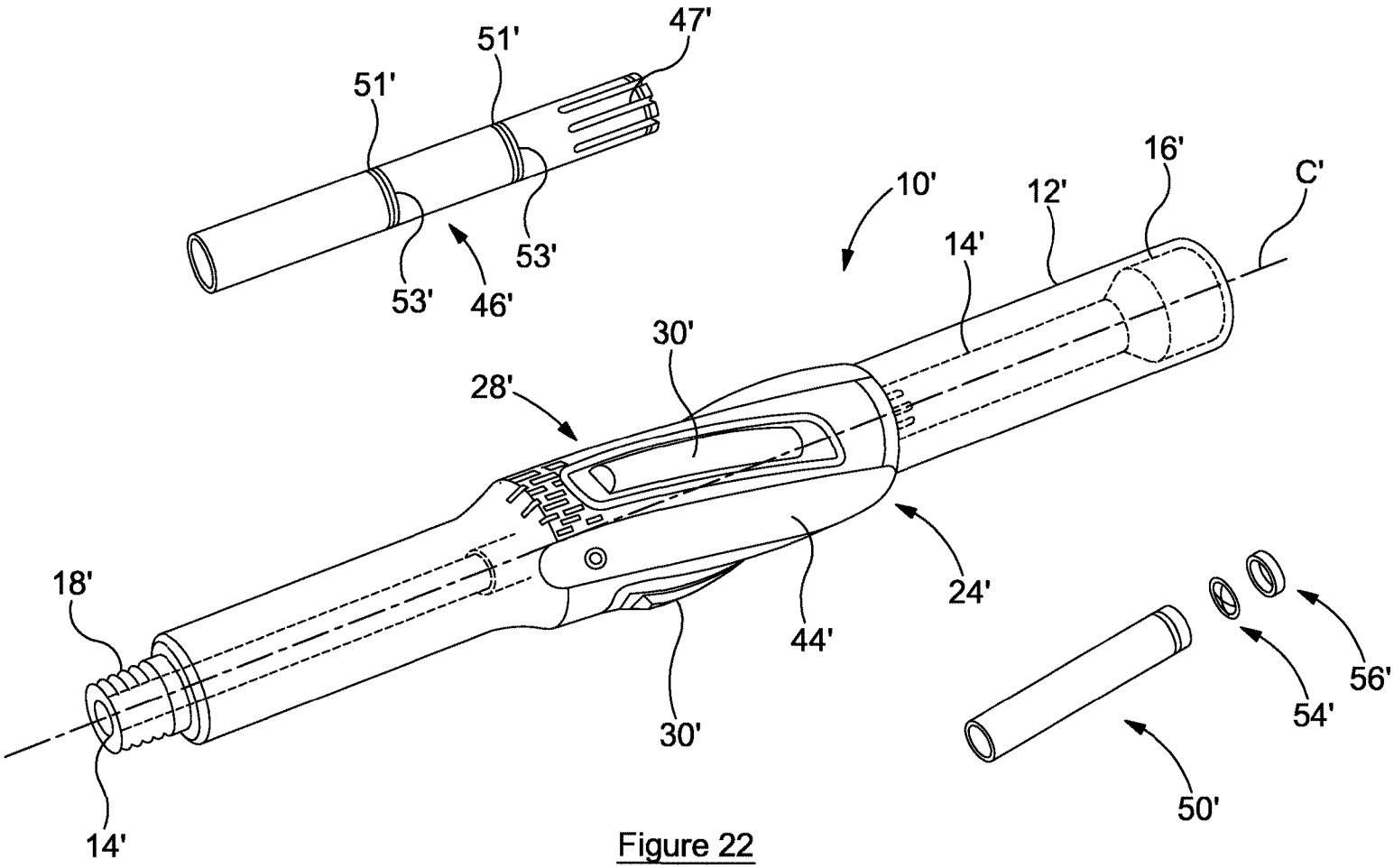
FIG. 22 is a perspective view of the apparatus of FIG. 21, showing the main body, collet sleeve and activation dart assemblies separately.

As shown in FIG. 22, it can be seen that upset diameter body portion 24' is formed from a number of helical blades with external passages 44' provided to permit fluid and debris bypass around the apparatus 10'.

As can be seen most clearly from FIG. 22, the apparatus 10' is configured so that the longitudinal axis of the traction roller 30' is skewed by between about 3 degrees to about 5 degrees relative to the longitudinal axis of the body 12'. The provision of a skew angle introduces a longitudinal component to the interaction between the traction roller 30' and the borehole wall such that, on rotation of the body 12', the roller 30' will, in addition to providing a rolling contact between the apparatus 10' and the borehole wall, provide a longitudinally directed force urging the apparatus 10' and associated coupled drill tubulars 20', 22' of the drill string along the inner wall of the borehole. In the embodiment shown, the direction of skew angle is selected to provide a reverse thrust force on the borehole wall which acts to urge the apparatus 10' in an up hole direction. However, it will be recognised that the skew angle may be selected to provide forward, downhole directed thrust force if required.

Figures 23, 24, 25:
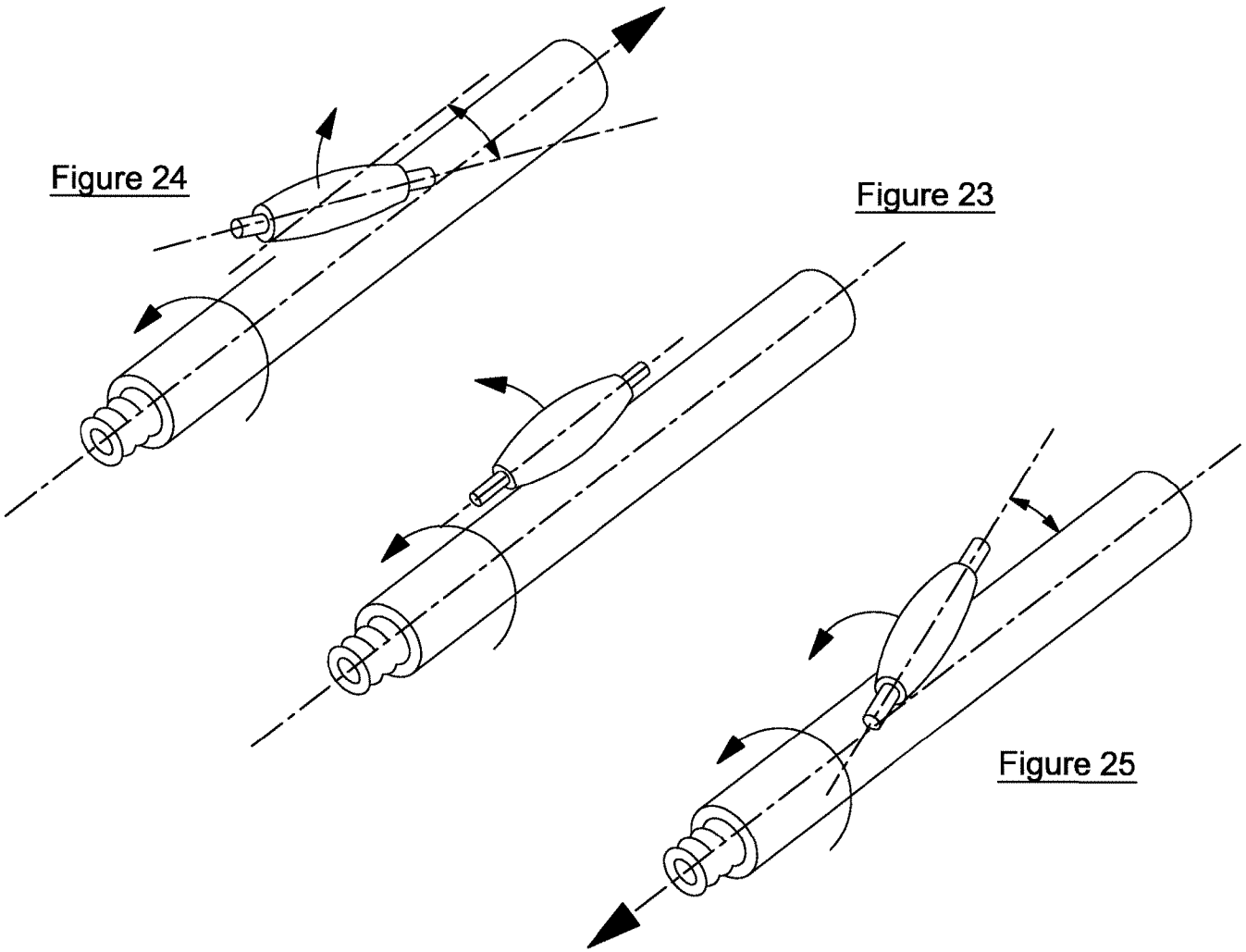
FIGS. 23-25 are diagrammatic views showing the mechanism of the present embodiment.
Figure 26:
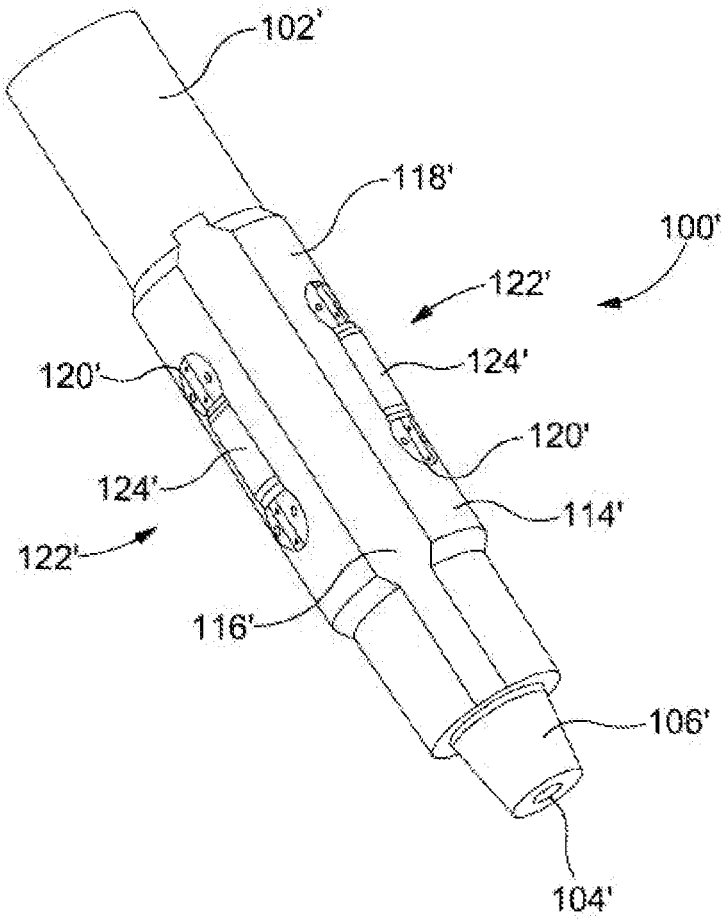
FIG. 26 is an isometric view of an apparatus according to another embodiment of the present invention.

To assist in understanding the mechanism of the present invention, reference is made to FIGS. 24 to 26 which show simplified perspective views showing a body and a single roller. FIG. 24 is shown for comparison and shows an arrangement having a roller mounted coaxially (no skew angle) on a body. In use, as the body rotates about its longitudinal axis, the roller about its longitudinal axis but in the opposite direction. As the roller has no skew angle with respect to the body, there is no longitudinal force component between the roller and the borehole wall and so no longitudinal movement of the body. Turning to FIGS. 25 and 26, where the roller is provided with a skew angle relative to the body, it will be recognised that the interaction between the roller and the borehole wall will now involve a longitudinal component, that is a component acting in the direction of the longitudinal axis of the body. As can be seen from FIGS. 25 and 26, where the roller is skewed in the direction shown in FIG. 25, rotation of the body in the direction shown will cause the body to be urged in the direction shown by the arrow A. Conversely, where the roller is skewed in the direction shown in FIG. 26, rotation of the body in the same direction will cause the body to be urged in the opposite direction, as shown by arrow B. As will be understood by the person skilled in the art, as a drill string is typically constructed from section of tubulars threadedly coupled together, a drill string will only be rotated in one direction to avoid the threaded coupling of the string from disengaging. Beneficially, embodiments of the present invention thus permit forward or reverse thrust to be achieved while also rotating the body in a single direction.

Referring again to FIGS. 21 and 22, in order to retain the apparatus 10' in the first, passive configuration, a collet sleeve 46' having fingers 47' is provided within the throughbore 14'. The sleeve 46' is secured within the throughbore 14' by a shear pin 48' and a national pipe thread (NPT) seal plug 49'. Elastomeric seals or rings 51' may be provided in grooves 53' in the collet sleeve 46' to isolate the section of the throughbore 14' around the roller assembly 28'.

In use, in order to activate the apparatus 10' from the first configuration to the second configuration, an activation dart 50' is dropped or driven down the drill string and into the apparatus throughbore 14'. A rupture disk 54' is secured to the dart 50' by a retainer ring 56' to prevent fluid passage through the dart 50' and allow the dart 50' to be propelled through the drill string.

Application or continued application of fluid pressure will overcome the shear limit of shear pin 48' to release the collet sleeve 48' to move relative to the body 12' and thereby expose the carrier surface 40' to fluid pressure sufficient to urge the carrier 32', and thus the roller 30', into contact with the borehole wall. The collet sleeve 46' will travel through the throughbore and engage a shoulder 54' provided in the throughbore 14'. Also, the collet fingers 47' will engage a groove 56' provided in the throughbore 14.

Still further application of fluid pressure will burst the rupture disk 54' and permit fluid or tool passage through the body 12'. Rupture of the disk 54' may be detected as surface, providing an indication that the apparatus has set. It will be understood that this process may be repeated for each apparatus 10', where a number of apparatus' 10' are provided.

Figure 28:
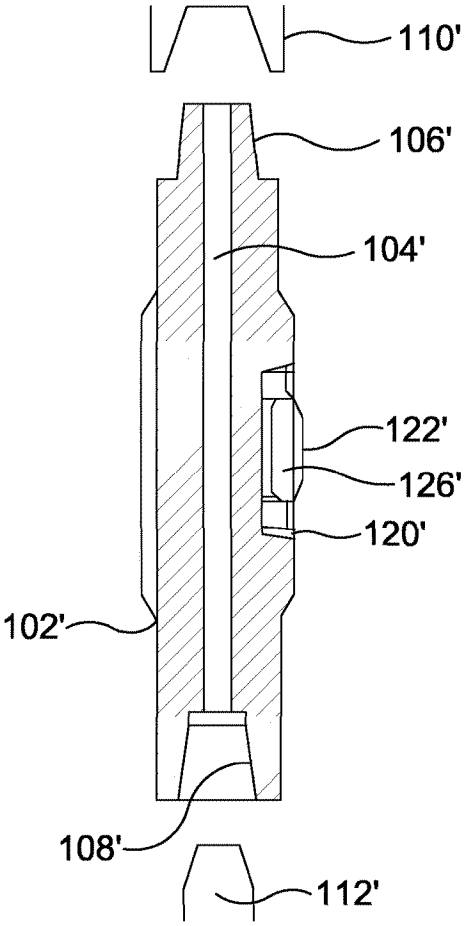
FIG. 28 is a longitudinal sectional view of the apparatus shown in FIGS. 26 and 27 along section A-A.
Figure 27:
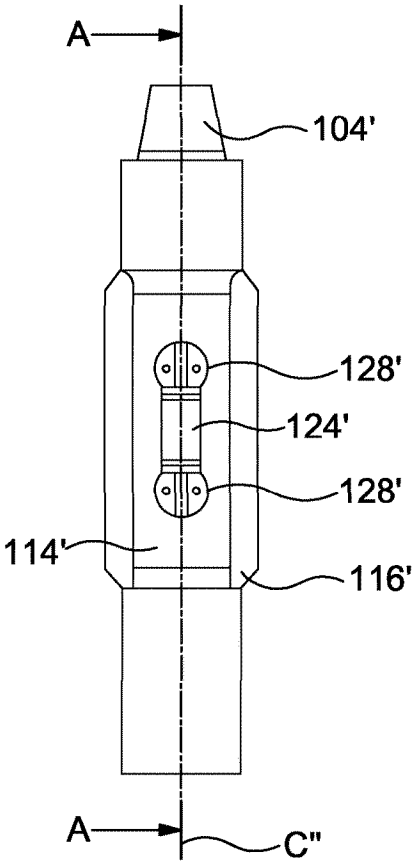
FIG. 27 is a plan view of the apparatus shown in FIG. 26.

Referring now to FIGS. 26, 27 and 28, there are shown perspective, plan and longitudinal sectional views of an apparatus 100' according to another aspect of the present invention. The apparatus 100' comprises a thick-walled cylindrical tool body 102' with a throughbore 104' and threadable attachment means in the form of threaded pin 106' and threaded box 108' (see FIG. 28) connections at either end for connecting the body 102' to drill tubulars 110', 112' (see FIG. 28).

The thick-walled cylindrical body 102' has an upset section 114' through which are machined fluid bypass grooves 116' to form raised sections or pads 118'. As shown in FIGS. 26 to 28, the raised pads 118' of the upset section 114' extend substantially axially along the body 102', although it will be recognized that the pads 118' and grooves 116' may be of any suitable configuration and may for example define a helical configuration similar to the portion 24' of apparatus 10' (shown in FIG. 22).

Machined bays or pockets 120' are formed in the pads 118', into which are mounted roller assemblies 122'. One pocket 120' and one roller assembly 122' may be provided. However, it is envisaged that the apparatus 100' may provide mounting for three roller assemblies 122', for example arranged in a spaced fashion at 120 degrees around the circumference of the body 102'.

Each roller assembly 122' has a roller 124' supported on a bearing shaft 126', the shaft 126' held in place at either end of the pocket 120' by means of two tapered latch locked retention blocks 128'. The blocks 128' are described in more detail below with reference to FIGS. 27, 28 and 29.

The bearing shaft 126' is angled or skewed with respect to the central longitudinal axis C" of the thick walled cylindrical tool body 110', thus skewing or applying angle to the roller 124' mounted on the shaft 126'. In the embodiment shown, the skew angle is selected to provide forward thrust force, urging the apparatus 100' and the coupled drill tubulars 110', 112' in a downhole direction. As the rotational speed of rotary drilling assemblies is normally limited between 100' and 200 rpm and the borehole diameter of the section drilled through the reservoir is generally but not always 8.5" (about 216 mm) or less, and the drilling rate of penetration generally below 100 ft. per minute (about 0.51 meters per second), then the skew angle required to provide efficient forward traction and transport system is relatively small, for example in the order of 0.5 degrees. However, in some circumstances it may be desirable to go higher.

In the embodiment shown, the machined pocket 120' does not extend into the throughbore 104' of the body 102' and so permanently defines an active configuration with the roller 124' contacting the inner borehole wall in use. However, in alternative embodiments the pocket 120' may be configured in a similar arrangement to that shown in FIGS. 1 and 2 which is capable of moving from a passive configuration to an active configuration.

Figure 29:
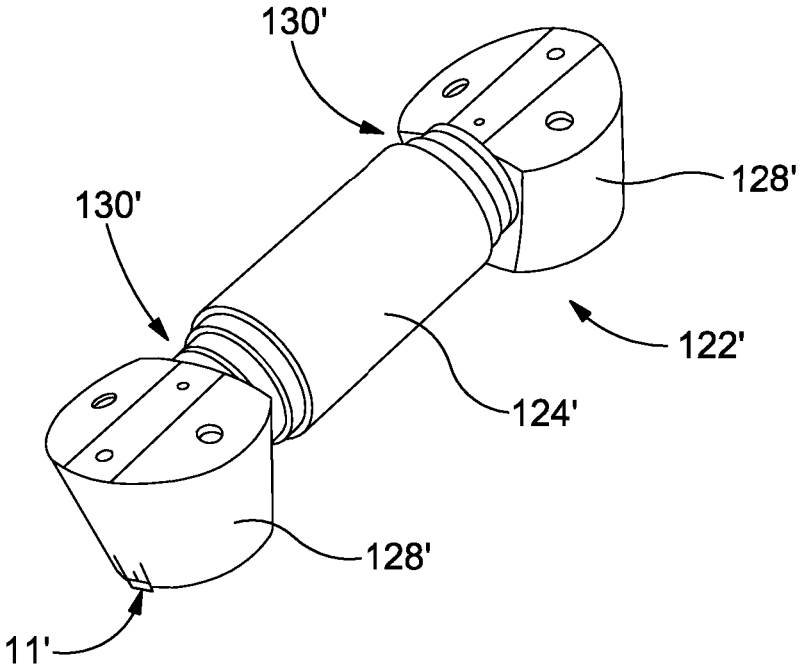
FIG. 29 is an enlarged perspective view of a roller assembly according to the present invention.
Figure 30:
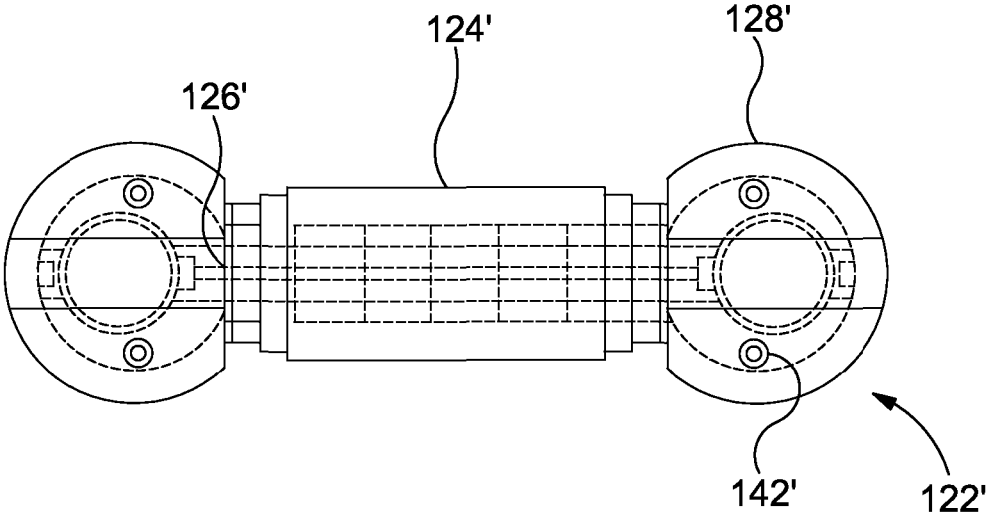
FIG. 30 is a plan view of the roller assembly of FIG. 29.
Figure 31:
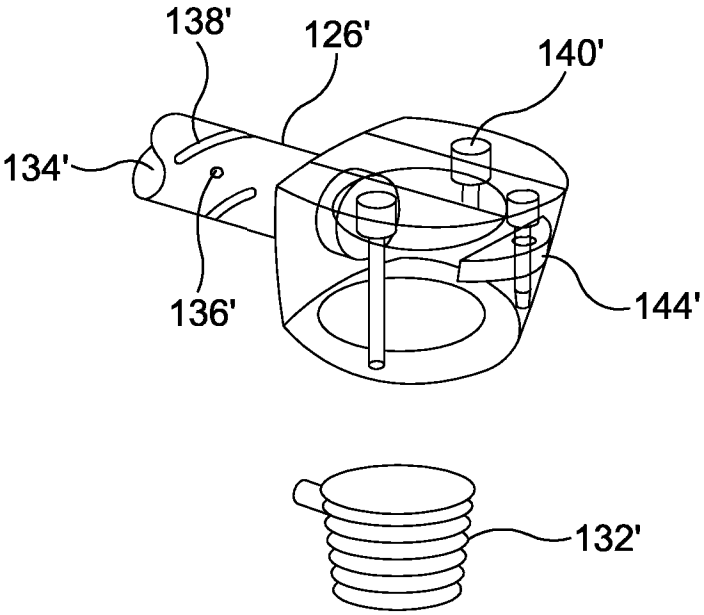
FIG. 31 shows an exploded view of part of the roller assembly shown in FIGS. 29 and 30.

Reference is now made to FIGS. 29 to 31 of which FIGS. 29 and 30 show isometric and plan views of a roller assembly 122' and FIG. 31 shows an exploded view. As shown, the roller assembly 122' has two tapered latch locked retention blocks 128' at either end of the roller shaft 126'. The blocks 128' are configured for location within a pocket, such as the pocket 120' provided in body 102'.

To construct the assembly 122', the roller 124' is mounted on bearings, including one or more pressure-compensated radial bearings 130'. Pressure-compensated lubricant is held within a pressure-compensated, modular, positive pressure reservoir 132' contained within the centre portion of one or both of the retention blocks 128'. Beneficially, the internal volume of the retention block or block 128' may provide the facility to contain substantially more lubricant than is currently provided in rolling element tools of equivalent size, thereby increasing the life of the radial bearings in operation.

The lubricant held within the positive pressured reservoirs 132' is fed into a drilled central bore 134' at either end of the bearing shaft and fed to the bearing by means of one or more cross-drilled hole 136' communicating between the drilled central bore 134' and lubrication grooves 138' machined on the external diameter of the shaft 126'.

The lubricant is retained within the bearing section of the roller 124' by rotary seals located at either end of the roller 124' between the external diameter of the shaft 126 and the internal diameter of the roller 124'.

The end thrust loads experienced by the roller 124' due to the traction forces may be supported by internal thrust bearings, for example contained within the pressure compensated area of the roller 124' and/or by mud lubricated thrust bearings situated at either end of the roller 124' outwith the sealed pressure compensated area between the roller 124' and the bearing faces on the retention blocks 128'.

The retention blocks 128' are secured by means of cap screws 140' passing through cap screw holes 142' in the retention blocks 128' and into threaded holes 143' at the bottom of the pocket 120'. A spring-loaded latch 144' is also installed on each retention block 128' to provide a secondary attachment means should the cap screws 140' fail. The spring-loaded latch 144' locks into a recess 145' in the pocket 120' and can only be released for disassembly by means of a release screw 146' inserted into a release screw hole 148'. In this arrangement, the latch mechanism 144' is integral with the retention blocks 128'. However, as an alternative to the construction shown and described above, and with reference to FIG. 32, the latch lock 11*a*' may alternatively be a separate sprung loaded component mounted higher up on the tapered retention block 128' and held in place for assembly purposes by the release screw 146' passing through a retention hole 150' in the latch lock component.

It should be understood that the above described embodiments describing the activatable traction member or members are also merely exemplary and that various modifications may be made thereto without departing from the scope of the invention.

For example, the roller assembly 122' may be adapted for use in an apparatus such as the apparatus 10' shown in FIGS. 21 and 22. The retention blocks, latch lock, lubrication and bearing elements of the roller assembly 122' may alternatively be formed in or provided on a carrier such as the carrier 32'.

In addition, at least one of the body, the upset diameter body portion/blade, or roller of any of the above described apparatus' may be provided or formed with a hard facing surface or material which may, for example be used to ream or grind the borehole.

Figure 32:
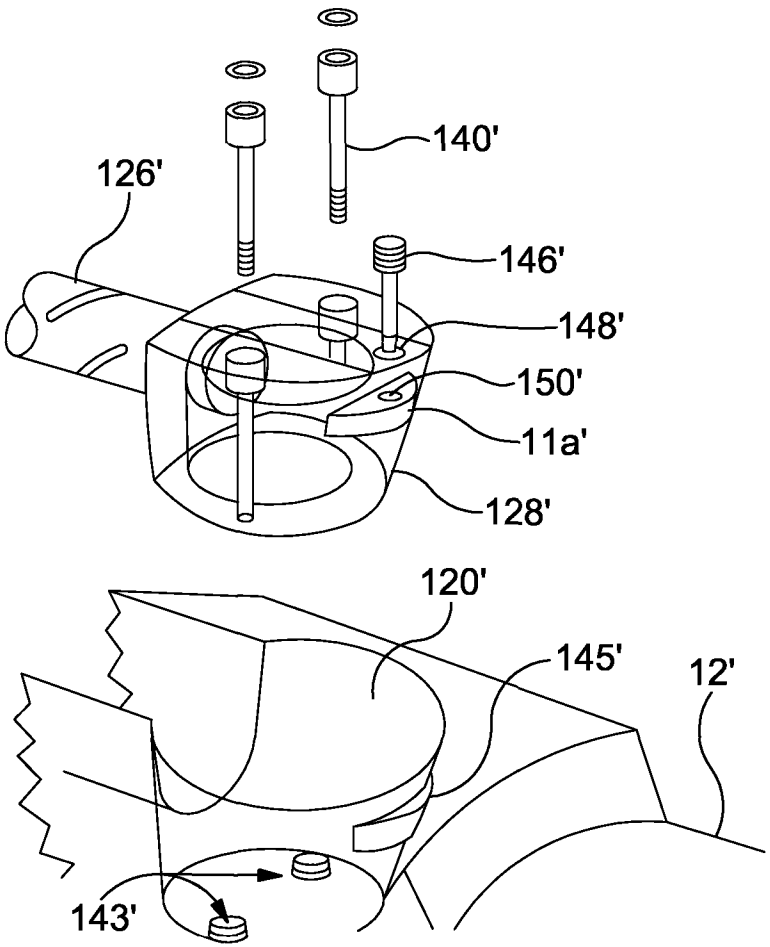
FIG. 32 shows an exploded view of part of a roller assembly and body showing an alternative construction.
Figure 33:
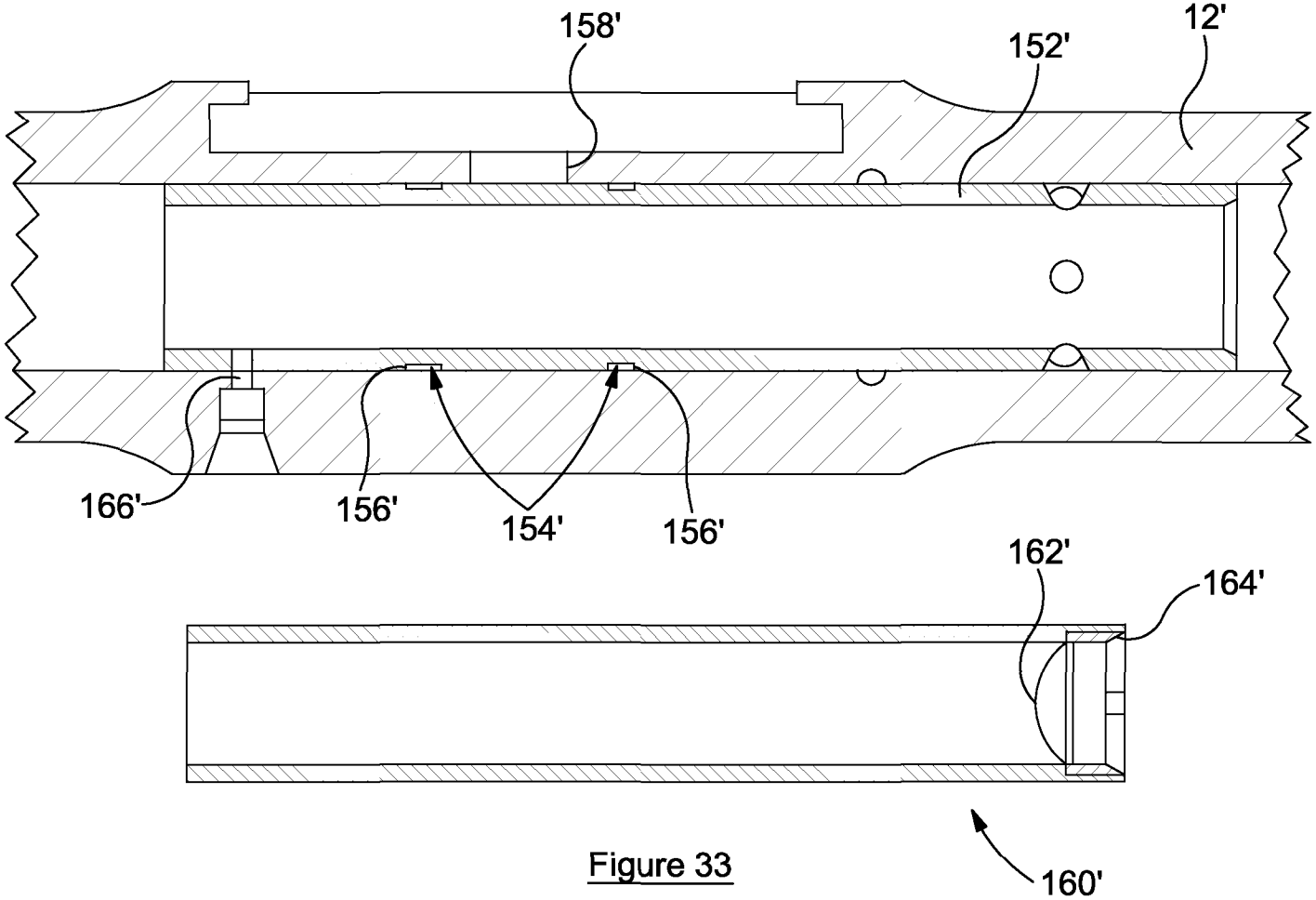
FIG. 33 shows a longitudinal section view of a ball retent sleeve and activation dart according to an alternative embodiment of the present invention.

Referring to FIG. 33, as an alternative to the collet sleeve described above, the sleeve may alternatively comprise a ball retent sleeve 152'. As shown in FIGS. 31 and 32, the sleeve 152' is adapted for location in the body 12' and comprises elastomeric seals 154' mounted in grooves 156' which in use straddle access port 158' through the body 12'. As with the collet sleeve, an activation dart 160', which may be identical to the dart 50' described above, with rupture disk 162' and retainer ring 164' mounted thereon may be dropped or propelled through the drill string and seats in the sleeve 152'. Applied pressure will shear the shear pin 166' and force the sleeve 152' downwards (to the left in the figure) to permit fluid access to the access port 158'. The sleeve 152' comprises a number of circumferentially spaced balls which engage with a ball detent groove to prevent further movement of the sleeve 152'.

In particular embodiments, the selected skew angle may be set at surface. However, the apparatus may alternatively be configured so that the traction member is activateable from a passive configuration to an active configuration. For example, the traction member may be positioned coaxially (that is, without a skew angle) relative to the longitudinal axis of the body at surface, activation of the apparatus from the passive configuration to the active configuration providing a skew angle.

Figure 34:
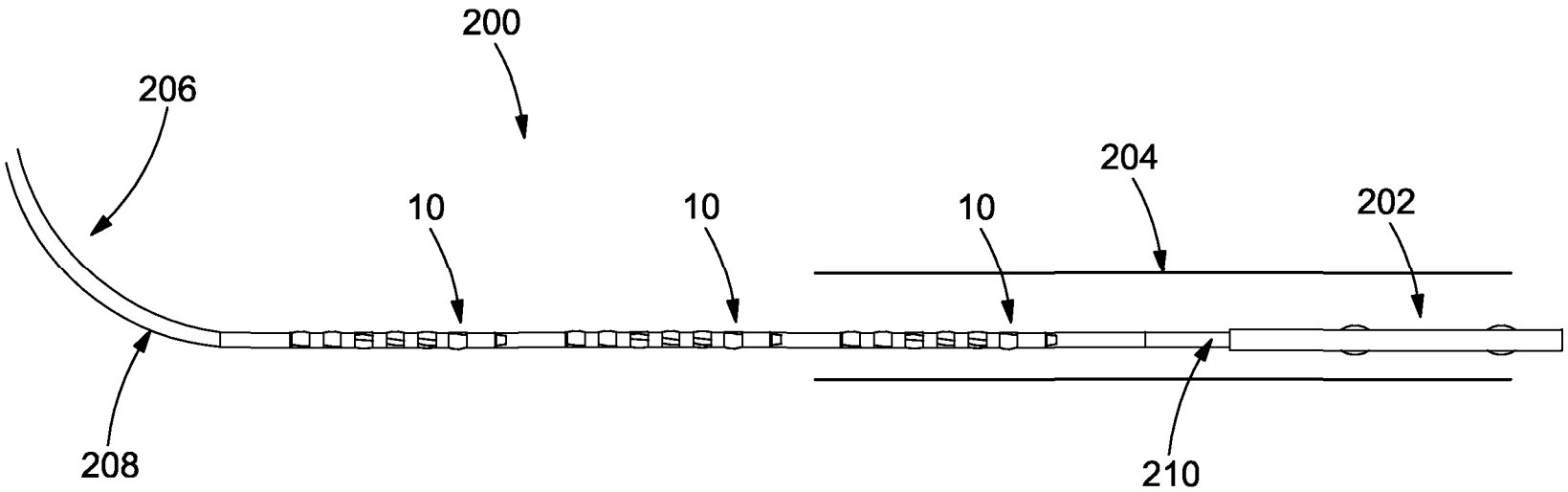
FIG. 34 shows an assembly according to an embodiment of the present invention.

FIG. 34 shows an assembly 200 according to an embodiment of the present invention. In the embodiment illustrated in FIG. 34, the assembly 200 is configured to deploy a liner 202 into a borehole having a high angle or horizontal section 204. The assembly 200 comprises a running string 206 comprising sections of drill pipe 208. A number of apparatus according to embodiments of the present invention are connected to the downhole end of the drill pipe 208. In the illustrated embodiment, three apparatus' 10 are shown, although any number of the apparatus may be employed as required. The distalmost apparatus 10 is coupled to the liner 202 by a swivel 210. In use, the string 206 is deployed into the borehole, the apparatus operable to push the string along the high angle or horizontal section 204 to assist in deploying the string 206 to the required depth. Once at the desired depth, the liner 202 may be installed and the string 206, including the apparatus' 10 may be withdrawn from the bore.

Figure 35:
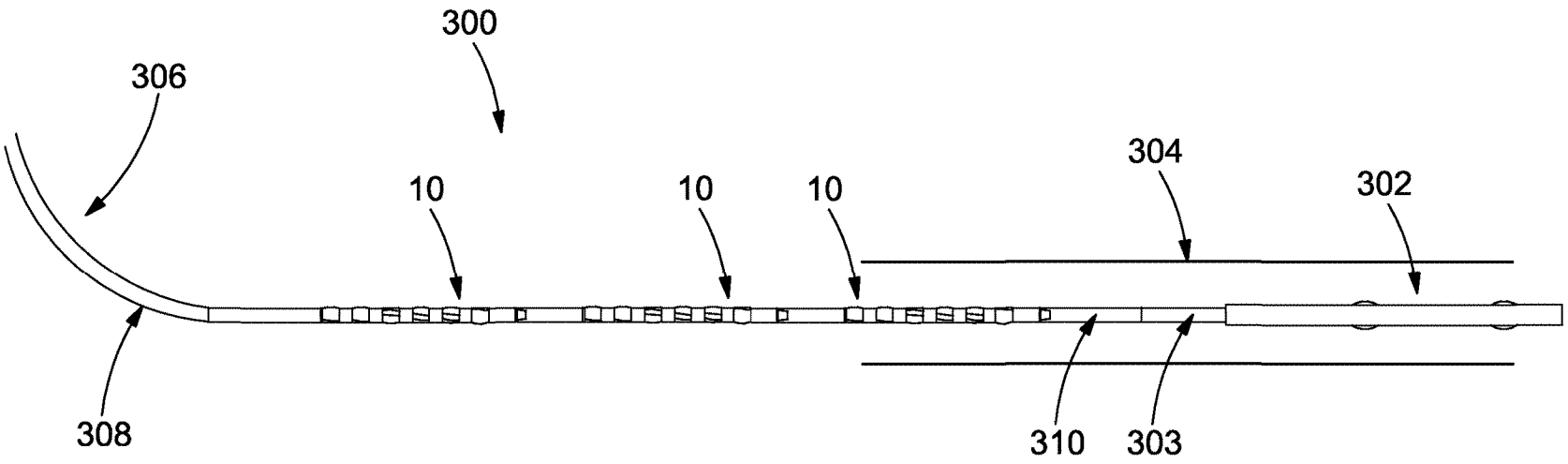
FIG. 35 shows an assembly according to another embodiment of the present invention.

FIG. 35 shows an assembly 300 according to another embodiment of the present invention. The assembly 300 is similar to the assembly 200. However, in this embodiment, the assembly 300 is configured to deploy production/completion equipment 302 and a liner hanger 303 into a borehole having a high angle or horizontal section 304. The assembly 300 comprises a running string 306 comprising sections of drill pipe 308. A number of apparatus according to embodiments of the present invention are connected to the downhole end of the drill pipe 308. In the illustrated embodiment, three apparatus' 10 are shown, although any number of the apparatus may be employed as required. The distalmost apparatus 10 is coupled to the liner 302 by a swivel 310. In use, the string 306 is deployed into the borehole, the apparatus' 10 operable to push the string 306 along the high angle or horizontal section 304 to assist in deploying the string 306 to the required depth. Once at the desired depth, the liner 302 may be installed and the string 306, including the apparatus' 10 may be withdrawn from the bore.

Figure 36:
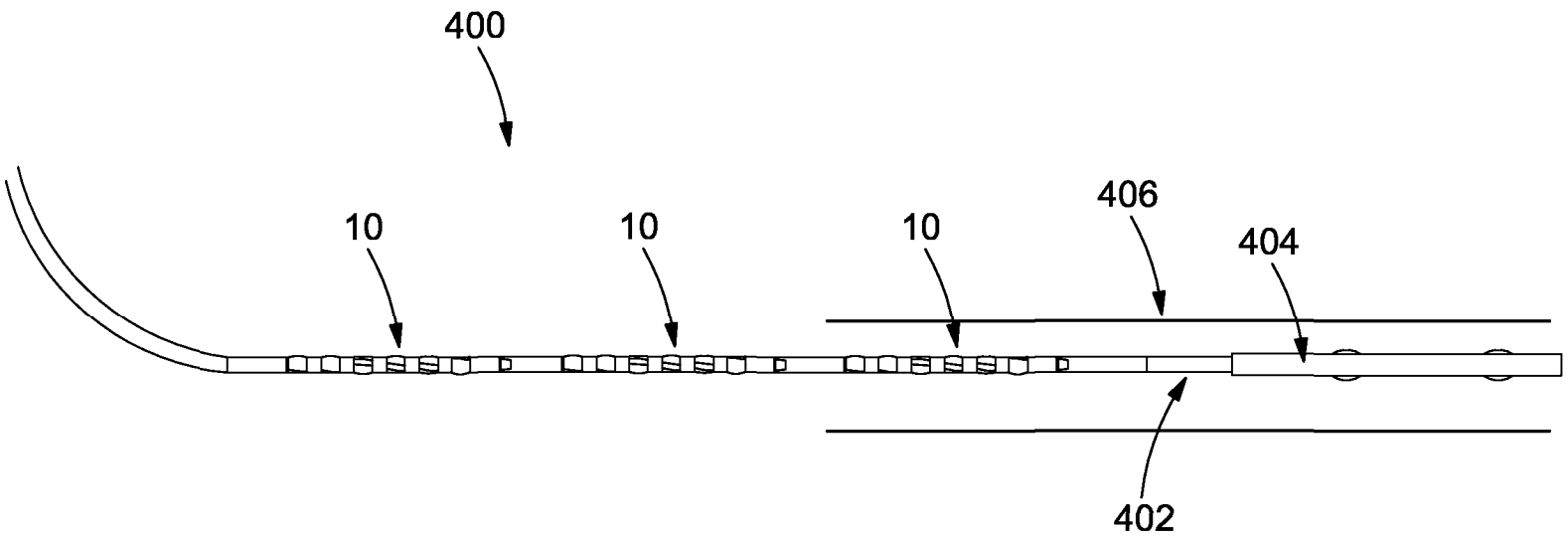
FIG. 36 shows an assembly according to another embodiment of the present invention.

FIG. 36 shows an assembly 400 according to another embodiment of the present invention. The assembly 400 is similar to the assembly 200 or 300. However, in the embodiment illustrated in FIG. 36, the assembly 400 is configured to deploy a hanger 402 and in-flow control valve 404 into a borehole having a high angle or horizontal section 406.

Figure 37:
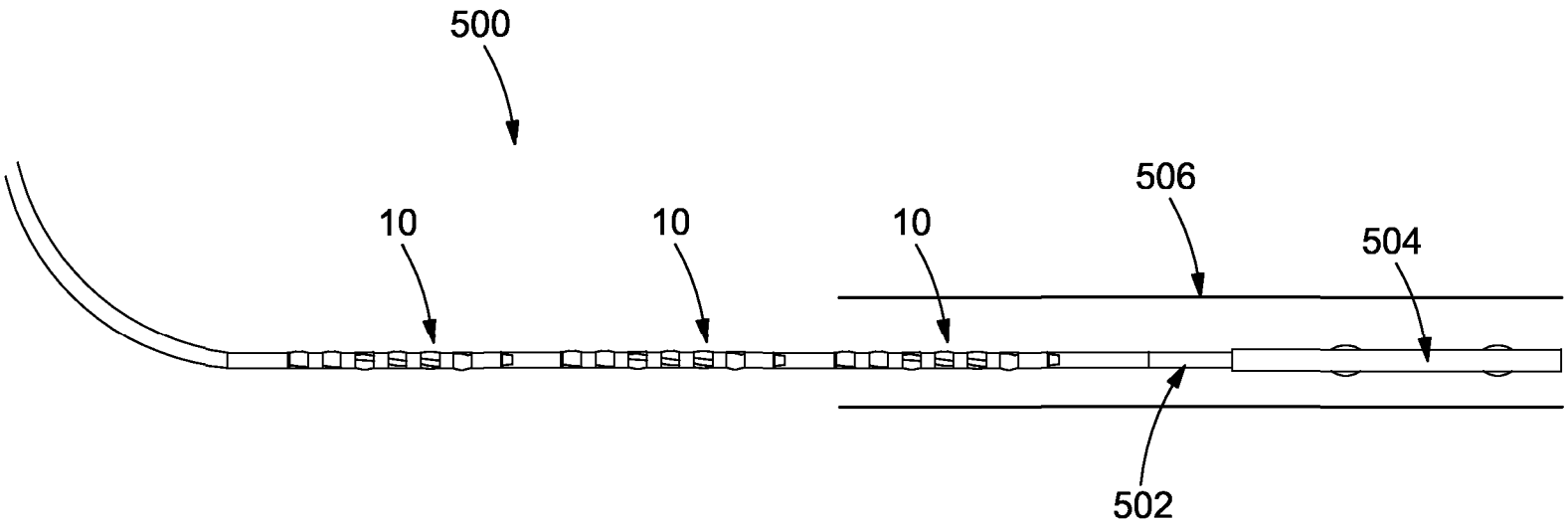
FIG. 37 shows an assembly according to another embodiment of the present invention.

FIG. 37 shows an assembly 500 according to another embodiment of the present invention. The assembly 500 is similar to the assembly 200, 300, or 400. However, in the embodiment illustrated in FIG. 37, the assembly 500 is configured to deploy a hanger 502 and sandscreen 504 into a borehole having a high angle or horizontal section 506.

Figure 38:
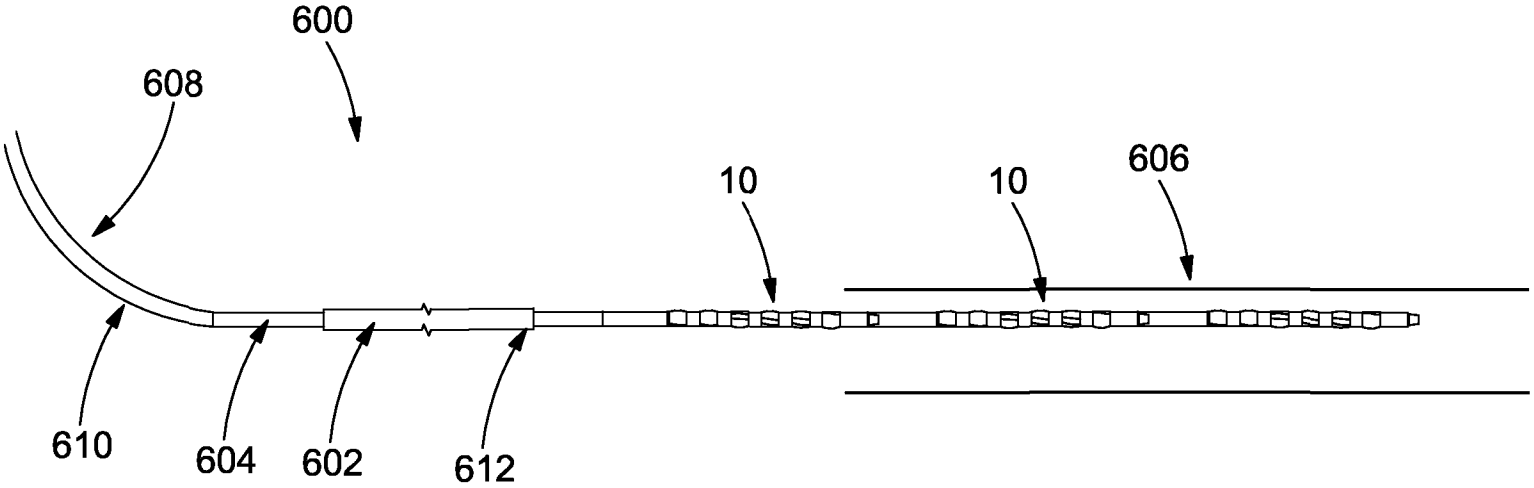
FIG. 38 shows an assembly according to another embodiment of the present invention.

FIG. 38 shows an assembly 600 according to another embodiment of the present invention. In the embodiment illustrated in FIG. 38 the assembly 600 is configured to deploy a liner 602 and liner hanger 604 into a borehole having a high angle or horizontal section 606. The assembly 600 comprises a running string 608 comprising sections of drill pipe 610 as in previous embodiments. However, in this embodiment the apparatus' 10 are positioned downhole of the liner 602 and liner hanger 604, the apparatus' 10 being coupled to the liner 602 via a downhole motor 612. In use, the motor 612 is operable to drive the apparatus' 10 to pull the liner 602 and liner hanger 604 to the desire depth. Once at the desired depth, the liner 602 and liner hanger 604 may be installed and the string 608 withdrawn. The motor 612 and/or the apparatus' 10 may be left in the borehole or, where possible, retrieved.

It should be understood that the above described embodiments describing the assemblies of the present invention are also merely exemplary and that various modifications may be made thereto without departing from the scope of the invention. For example, while all of the apparatus shown in the embodiments of FIGS. 34 to 38 are illustrated as apparatus 10, one or more of the apparatus may comprise an activatable apparatus according to embodiments described hereinabove.

The invention claimed is:

1. An apparatus for location in a borehole, the apparatus comprising:

a body;

a traction member comprising a sleeve configured for location around the body, the traction member rotatably mountable on the body so that the traction member rotates around the body, wherein the traction member is mountable on the body so as to define a skew angle relative to a longitudinal axis of the body and is configured to engage a wall of a borehole or bore-lining tubular to urge the apparatus along the wall of the borehole or bore-lining tubular on rotation of the traction member relative to the body; and a fluid lubricated bearing between the traction member and the body wherein at least a part of the fluid lubricated bearing is formed on the traction member, wherein at least part of the traction member comprises, is formed with, or receives an elastomeric or polymer material, the inner surface of the elastomeric or polymer material provided with flutes and pads to create the fluid lubricated bearing.

2. The apparatus of claim 1, wherein the traction member is mountable on the body so that the traction member is offset from a central longitudinal axis of the body.

3. The apparatus of claim 1, wherein the traction member is rotatably mountable on the body so that the traction member transmits force to the body.

4. The apparatus of claim 1, wherein the traction member is configured to engage with at least one other traction member.

5. The apparatus of claim 1, wherein the traction member comprises a radially extending rib or blade or other upset diameter portion.

6. The apparatus of claim 1, wherein the traction member is formed to define the skew angle.

7. The apparatus of claim 1, wherein the body defines the skew angle.

8. The apparatus of claim 1, wherein the angle of skew of the traction member is selected to urge the apparatus along the wall of the borehole at a selected rate.

9. The apparatus of claim 1, wherein a direction of skew angle of the traction member is selected to urge the apparatus in a selected direction along the wall of the borehole.

10. The apparatus of claim 1, wherein the apparatus is configured so as to have a first, passive configuration and a second, active, configuration in which the traction member urges the apparatus along the inner wall of the borehole or bore-lining tubular.

11. The apparatus of claim 1, wherein the body comprises a connector for coupling the body to a tubular string.

12. The apparatus of claim 1, comprising a plurality of the traction members, wherein at least one of:

a plurality of the traction members are configured for location on the body in abutting relation to each other; and a plurality of the traction members are longitudinally spaced along the length of the body.

13. An assembly comprising:

a borehole tubular; and at least one apparatus according to claim 1.

14. The assembly of claim 13, wherein the assembly comprises a downhole drive and rotation of the body is effected at least partly by the downhole drive.

15. The assembly of claim 14, wherein at least one of the apparatus' is arranged at selected downhole locations, so as to provide a traction force at a selected location of the borehole.

16. The assembly of claim 13, wherein one or more apparatus is provided adjacent a distal leading end of the assembly.

17. The assembly of claim 13, wherein the assembly is configured to provide increased thrust in a selected direction and/or provide different amounts of thrust at different points along the length of the assembly.

* * * * *